US006935431B2

(12) United States Patent
Dewey et al.

(10) Patent No.: US 6,935,431 B2
(45) Date of Patent: Aug. 30, 2005

(54) WELL REFERENCE APPARATUS AND METHOD

(75) Inventors: Charles H. Dewey, Houston, TX (US); John E. Campbell, Houston, TX (US); Wei Xu, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/629,990

(22) Filed: Jul. 30, 2003

(65) Prior Publication Data

US 2004/0020648 A1 Feb. 5, 2004

Related U.S. Application Data

(62) Division of application No. 10/171,215, filed on Jun. 12, 2002, now Pat. No. 6,648,069, which is a division of application No. 09/573,584, filed on May 18, 2000, now Pat. No. 6,499,537.

(60) Provisional application No. 60/134,799, filed on May 19, 1999.

(51) Int. Cl.[7] ..... E21B 23/01

(52) U.S. Cl. ..... 166/382; 166/50; 166/117.5; 175/45

(58) Field of Search ..... 166/302, 313, 166/255.1, 50, 117.5, 117.6; 175/45, 79

(56) References Cited

U.S. PATENT DOCUMENTS

| | | | | |
|---|---|---|---|---|
| 4,153,109 | A | 5/1979 | Szescila | 166/250 |
| 4,285,399 | A | 8/1981 | Holland et al. | 166/113 |
| 4,304,299 | A | 12/1981 | Holland et al. | 166/255 |
| 4,307,780 | A | 12/1981 | Curington | 166/113 |
| 4,393,929 | A | 7/1983 | Akkerman | 166/134 |
| 4,397,355 | A | 8/1983 | McLamore | 166/297 |
| 4,440,222 | A | 4/1984 | Pullin | 166/117.5 |
| 4,440,223 | A | 4/1984 | Akkerman | 166/217 |
| 4,646,831 | A | 3/1987 | Marsh et al. | 166/242 |
| 4,732,212 | A | 3/1988 | Fraser, III | 166/216 |

(Continued)

FOREIGN PATENT DOCUMENTS

| | | | |
|---|---|---|---|
| GB | 2191 803 | 12/1987 | E21B/23/00 |
| GB | 2291447 | 8/1995 | E21B/23/01 |
| WO | WO 01/88336 | 11/2001 | E21B/47/09 |

OTHER PUBLICATIONS

PCT Search Report for International Application No. PCT/US01/16442 Dated Aug. 28, 2001 (7 p.).

Praful C. Desai and Charles H. Dewey; Smith International, Inc., Red baron Group; IADC/SPE 59237; *Milling Variable Window Openings for Sidetracking*; 2000 IADC/SPE Drilling Conference, New Orleans, LA, Feb. 23–25, 2000; (9 p.).

UK Search Report for Application No. GB 0012227.5 dated Oct. 18, 2000.

*Primary Examiner*—Frank Tsay
(74) *Attorney, Agent, or Firm*—Conley Rose, P.C.

(57) ABSTRACT

The well reference apparatus and method of the present invention includes a reference member preferably permanently installed within the borehole at a preferred depth and orientation in one trip into the well. The reference member provides a permanent reference for the location of all operations, particularly in a multi-lateral well. The assembly of the present invention includes disposing the reference member on the end of a pipe string. An orienting tool such as an MWD collar is disposed in the pipe string above the reference member. This assembly is lowered into the borehole on the pipe string. Once the preferred depth is attained, the MWD is activated to determine the orientation of the reference member. If the reference member is not oriented in the preferred direction, the pipe string is rotated to align the reference member in the preferred direction. This process is repeated for further corrective action and to verify the proper orientation of the reference member. Upon achieving the proper orientation of the reference member, the reference member is set within the borehole and the pipe string is disconnected from the reference member and retrieved.

21 Claims, 17 Drawing Sheets

U.S. PATENT DOCUMENTS

| | | | | | |
|---|---|---|---|---|---|
| 4,750,563 | A | | 6/1988 | Baugh | 166/382 |
| 4,762,177 | A | | 8/1988 | Smith, Jr. | 166/216 |
| 5,174,397 | A | | 12/1992 | Currington | 175/423 |
| 5,443,129 | A | * | 8/1995 | Bailey et al. | 175/45 |
| 5,467,819 | A | | 11/1995 | Braddick | 166/117.6 |
| 5,592,991 | A | | 1/1997 | Lembcke et al. | 166/298 |
| 5,771,972 | A | | 6/1998 | Dewey et al. | 166/298 |
| 5,871,046 | A | | 2/1999 | Robison | 166/241 |
| 5,878,818 | A | * | 3/1999 | Hebert et al. | 166/382 |
| 5,894,889 | A | | 4/1999 | Dewey et al. | 166/298 |
| 6,003,621 | A | * | 12/1999 | Murray | 175/79 |
| 6,021,714 | A | | 2/2000 | Grove et al. | 102/307 |
| 6,143,377 | A | | 11/2000 | Miyamoto | 166/118 |
| 6,354,375 | B1 | * | 3/2002 | Dewey | 166/313 |
| 6,488,095 | B2 | * | 12/2002 | Buytaert | 166/382 |
| 6,499,537 | B1 | * | 12/2002 | Dewey et al. | 166/255.1 |
| 6,648,069 | B2 | * | 11/2003 | Dewey et al. | 166/50 |

* cited by examiner

FIG.6
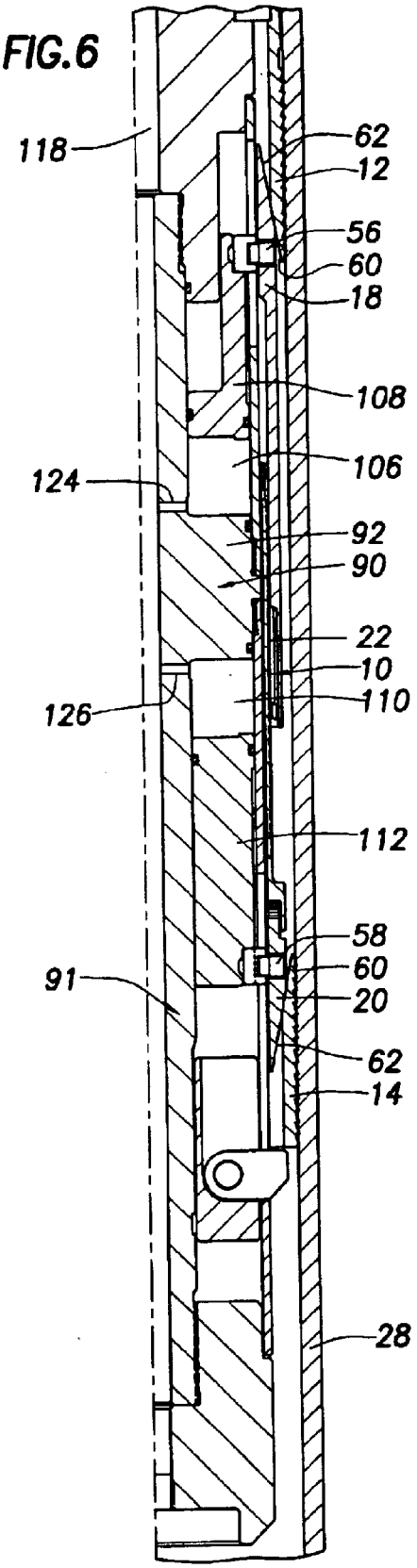
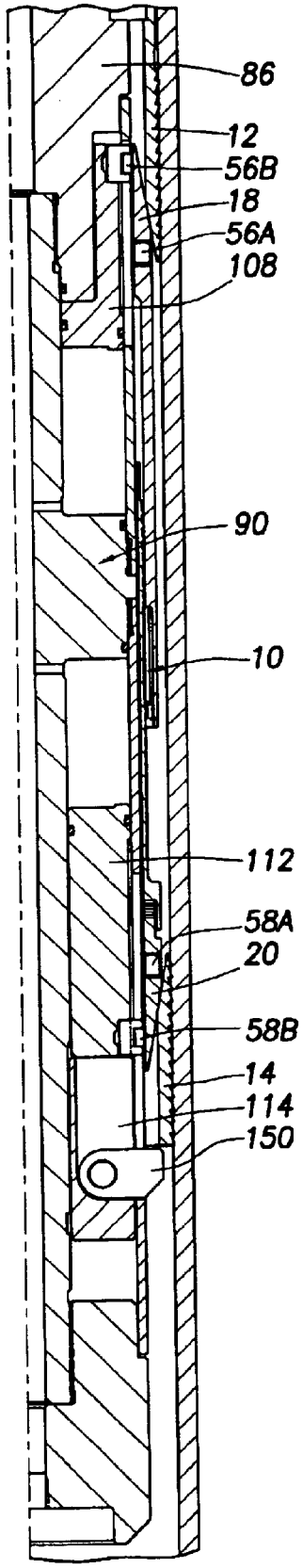
FIG.7

FIG.8
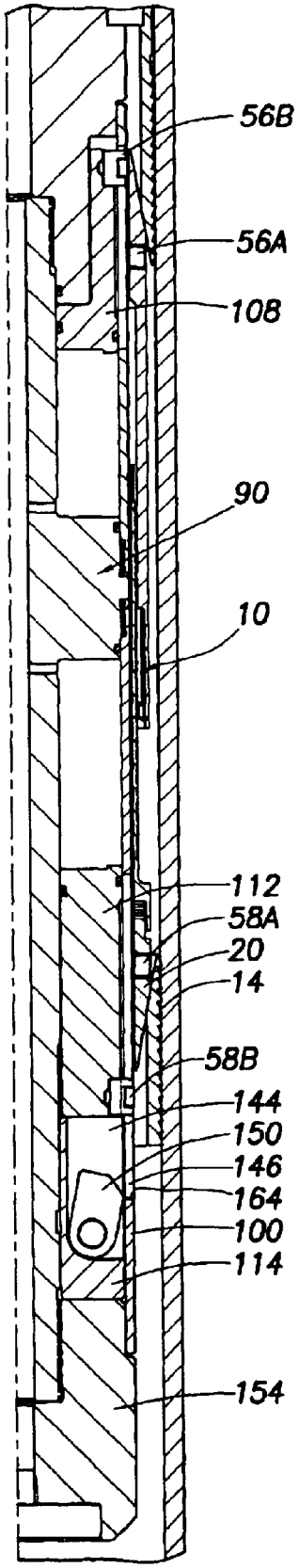
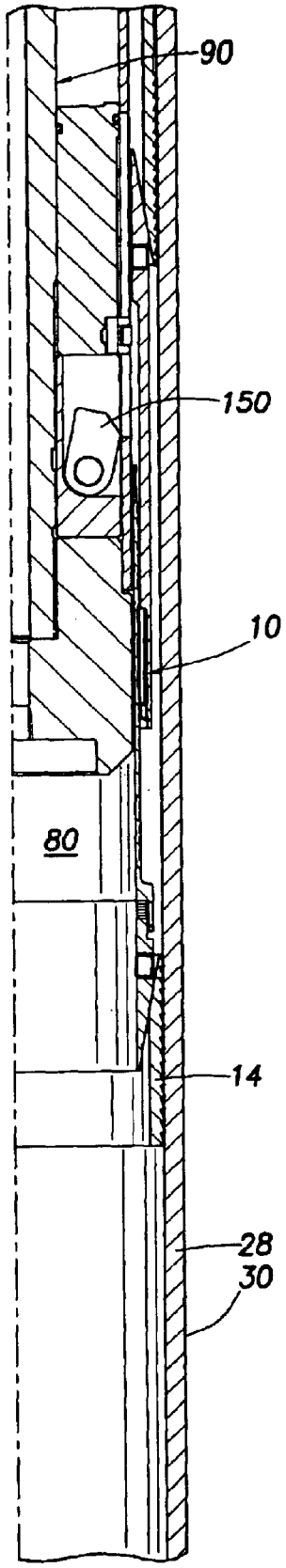
FIG.9

200

200

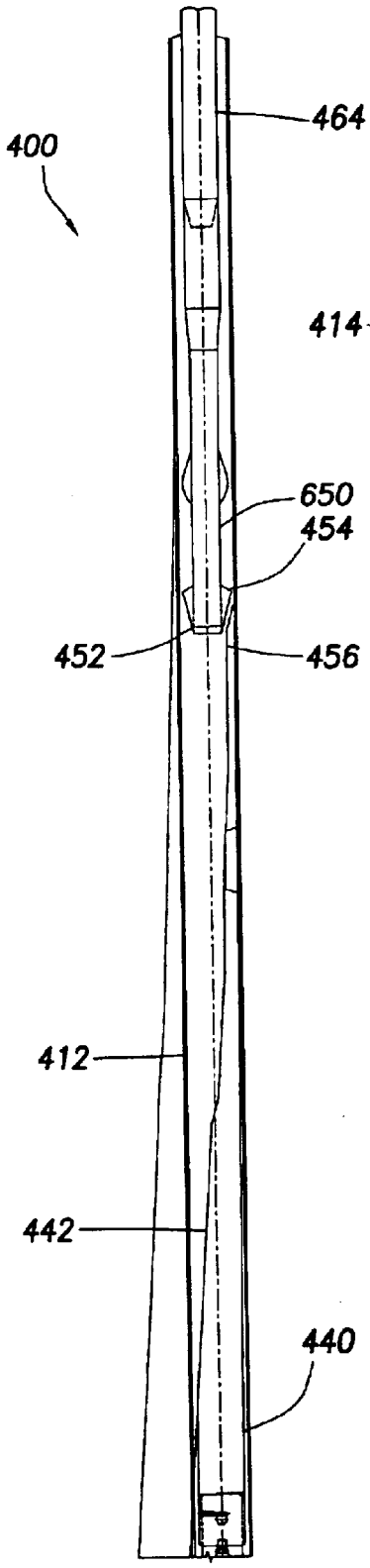
FIG. 15A1
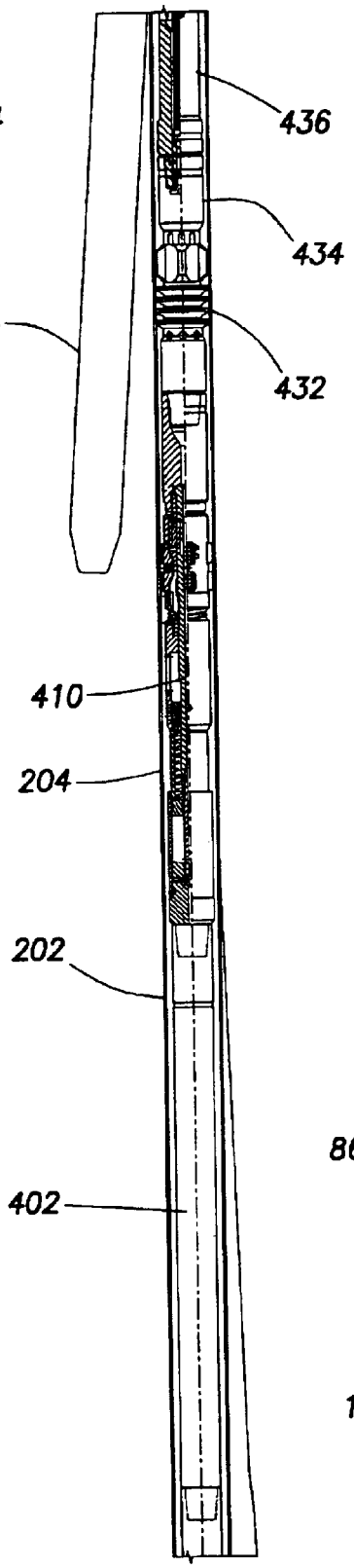
FIG. 15A2
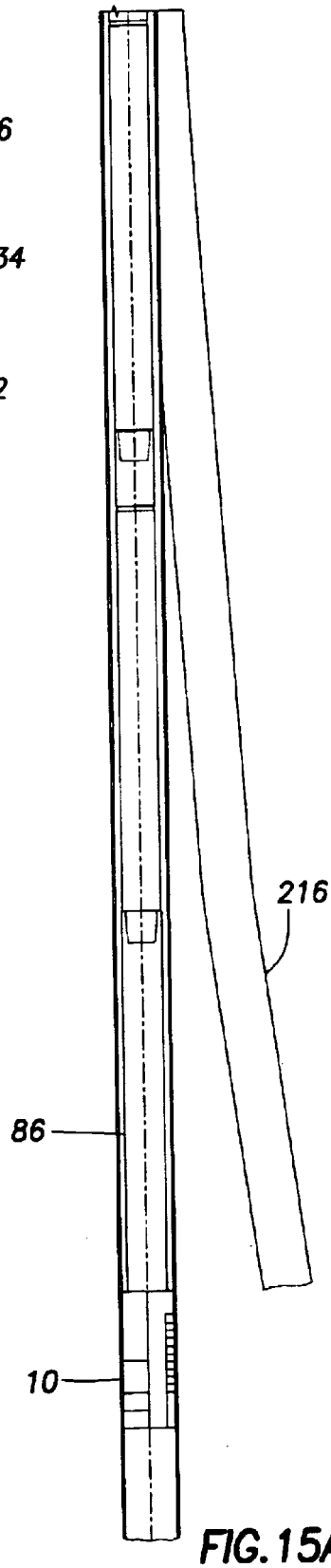
FIG. 15A3

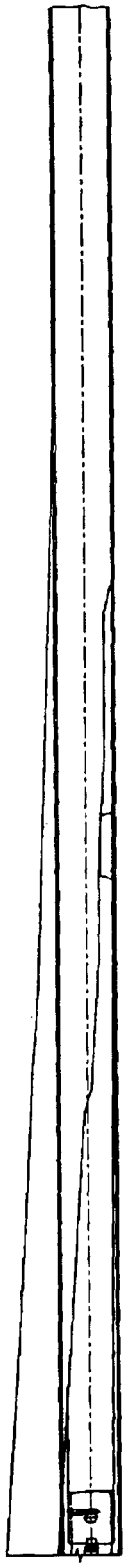
FIG. 15B1
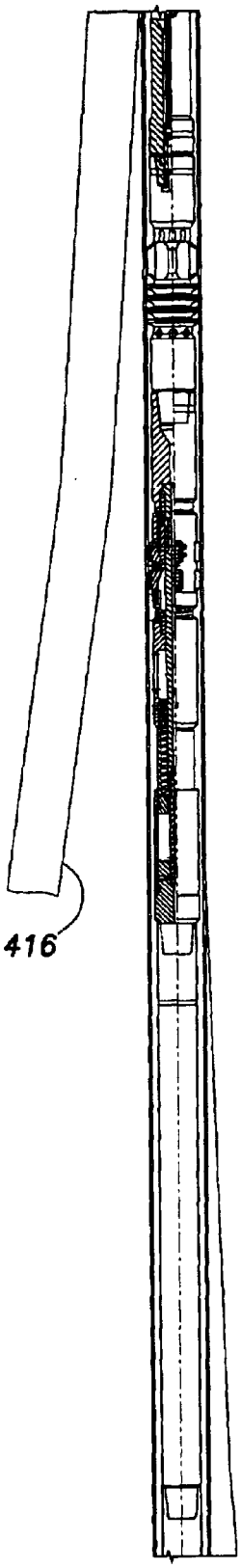
FIG. 15B2
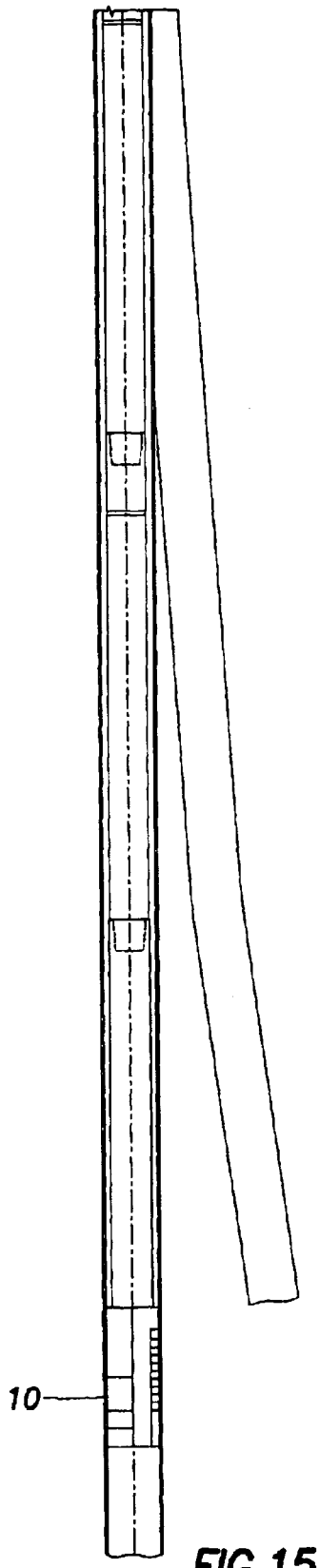
FIG. 15B3

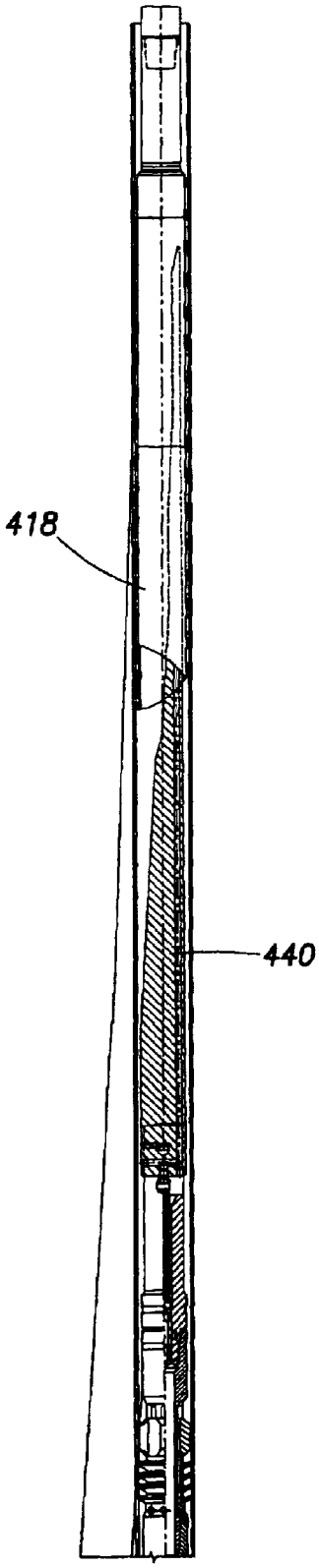
FIG. 15C1
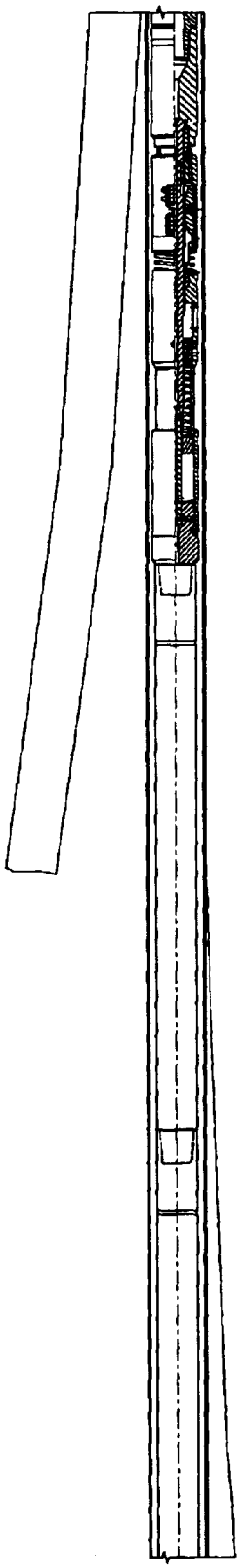
FIG. 15C2
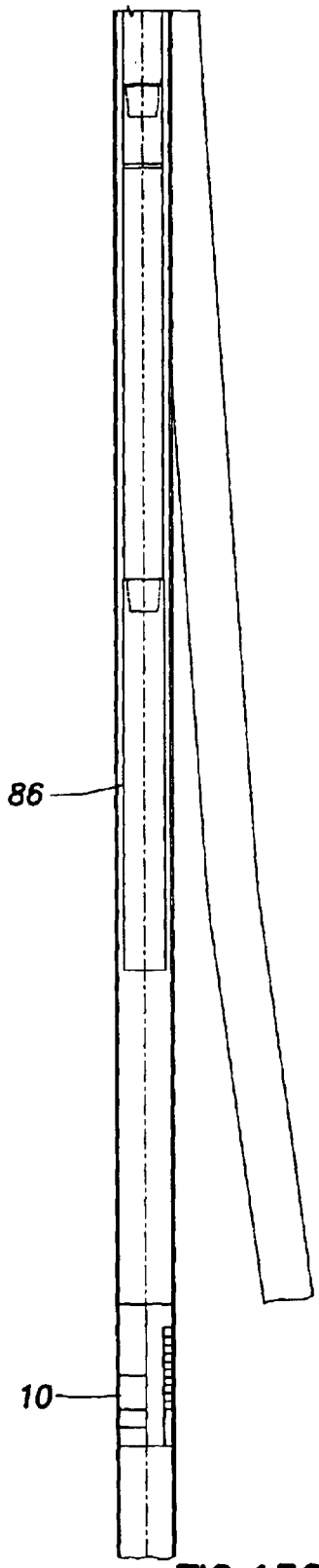
FIG. 15C3

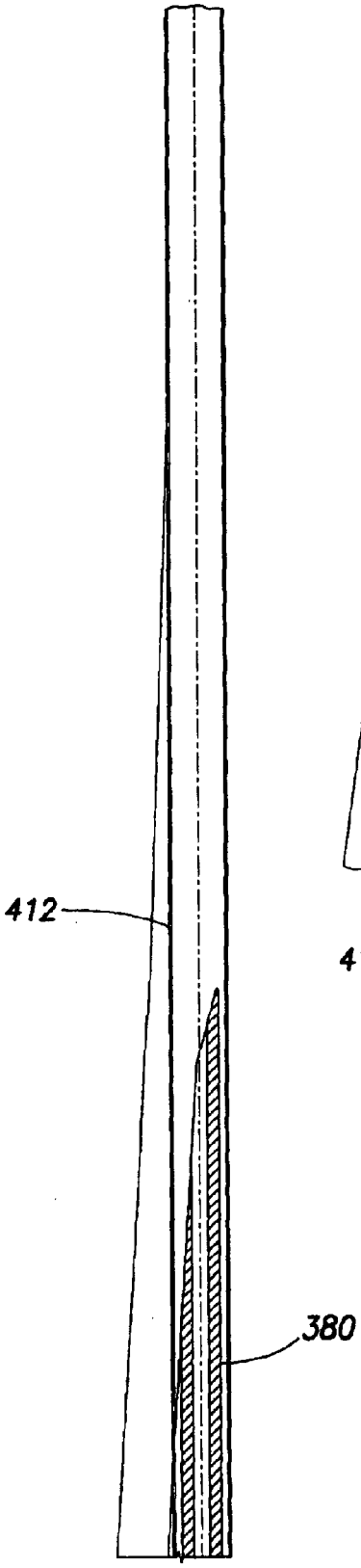
FIG. 15D1
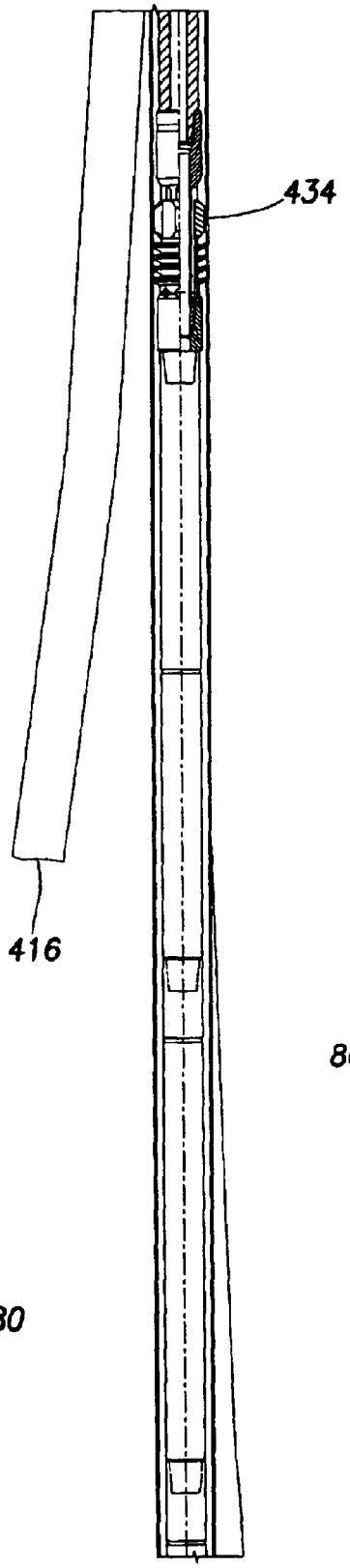
FIG. 15D2
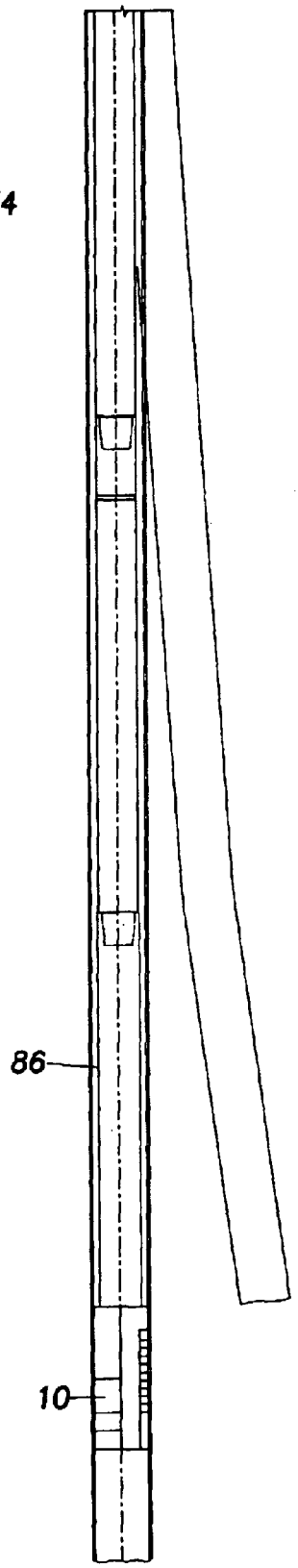
FIG. 15D3

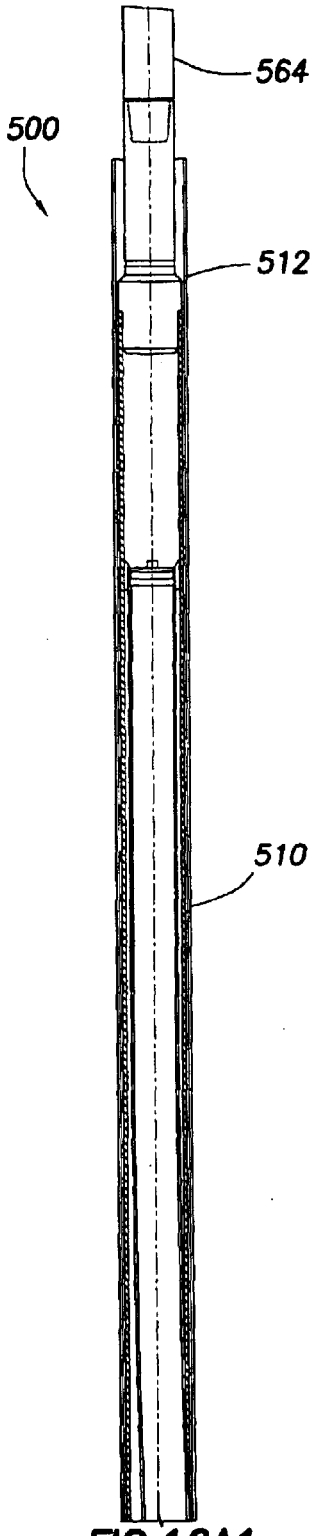
FIG. 16A1
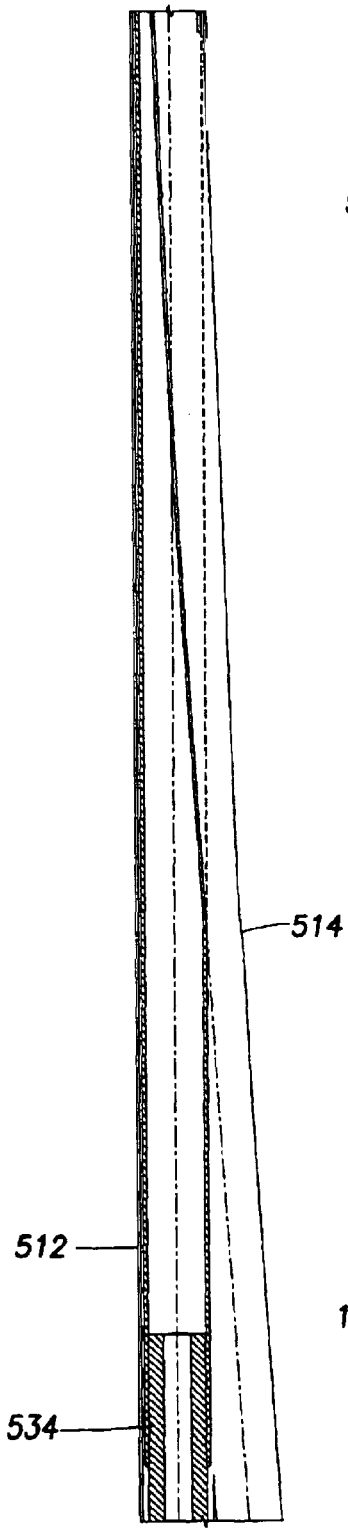
FIG. 16A2
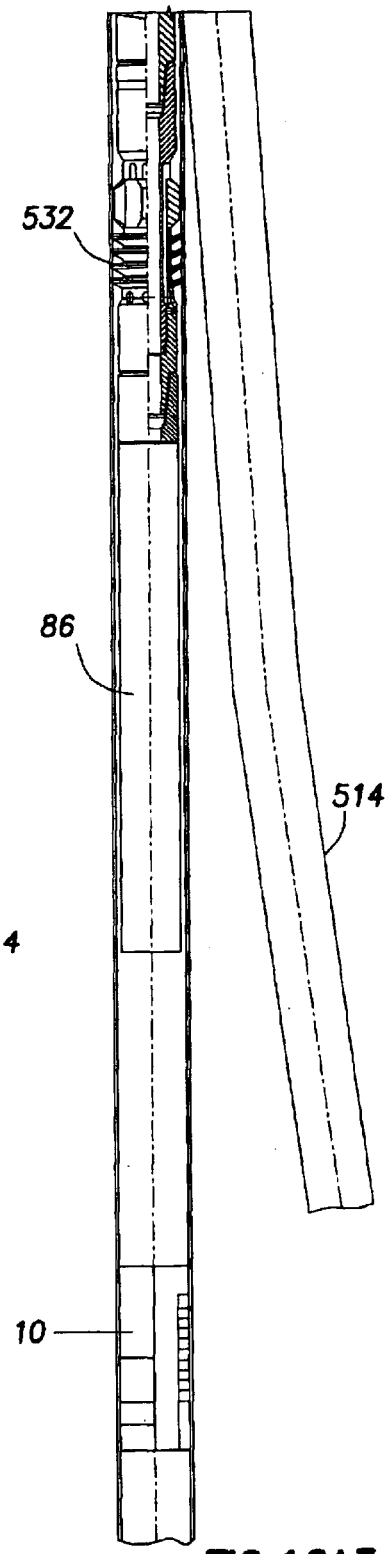
FIG. 16A3

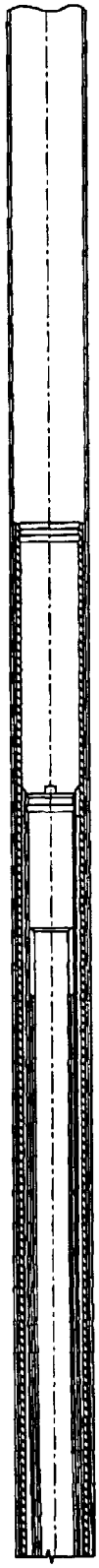
FIG. 16B1
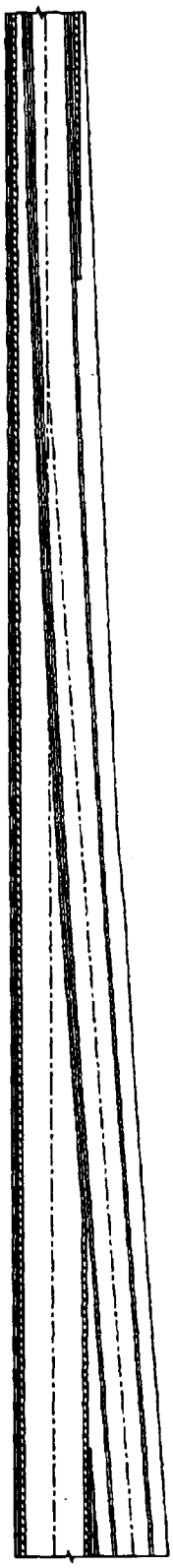
FIG. 16B2
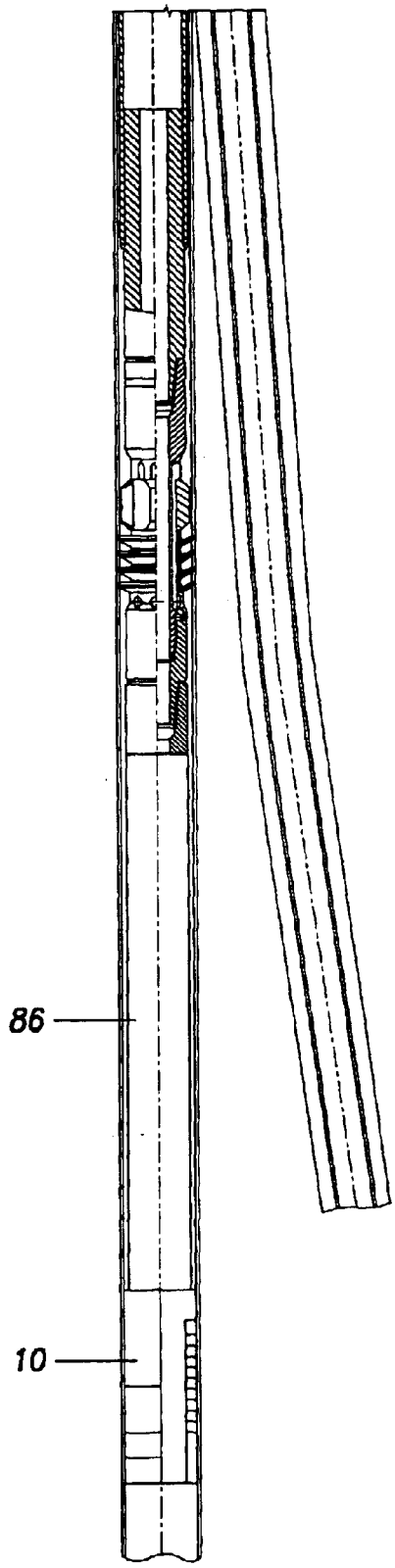
FIG. 16B3

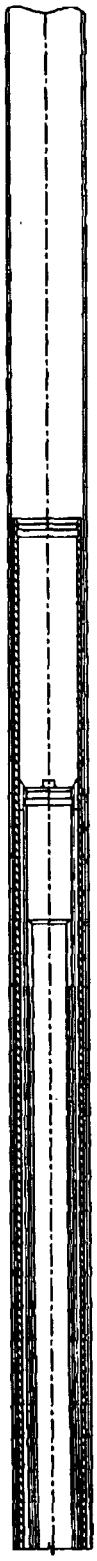
FIG. 16C1
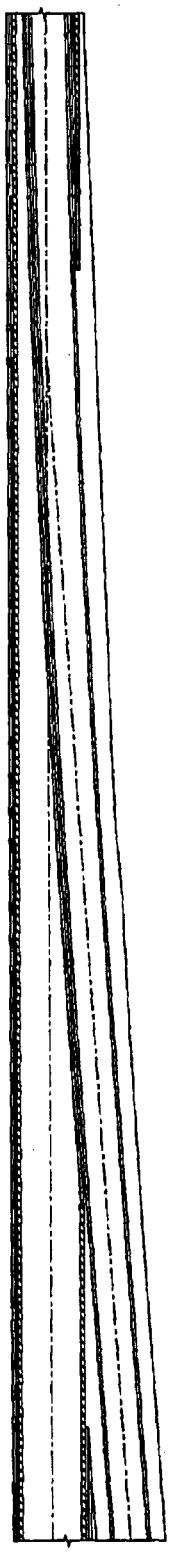
FIG. 16C2
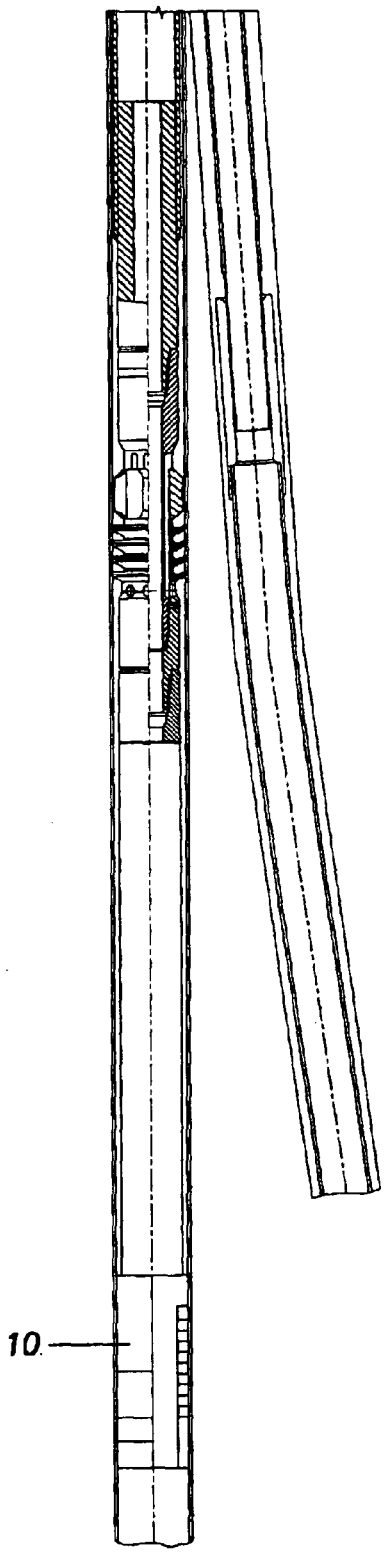
FIG. 16C3

WELL REFERENCE APPARATUS AND METHOD

CROSS-REFERENCE TO RELATED APPLICATIONS

This is a divisional application of pending U.S. patent application Ser. No.10/171,215, filed Jun. 12, 2002 and entitled "Well Reference Apparatus and Method", now U.S. Pat. No. 6,648,069, which is a divisional application of U.S. patent application Ser. No. 09/573,584, filed May 18, 2000 and entitled "Well Reference Apparatus and Method," now U.S. Pat. No. 6,499,537, which claims the benefit of U.S. Provisional Application Serial No. 60/134,799 under 35 U.S.C. 119(e), filed May 19, 1999 and entitled "Well Reference Annaratus and Method," all hereby incorporated herein by reference.

BACKGROUND OF THE INVENTION

1. Field of the Invention

The present invention relates generally to apparatus and methods for conducting well operations at a particular depth and angular orientation within a borehole and more particularly, to apparatus and methods for permanently marking a depth and angular orientation within the borehole, and still more particularly to a reference number set at a particular depth and orientation in the borehole for conducting a well operation such as a sidetracking operation in a single trip into the well.

2. Description of the Related Art

Well operations are conducted at a known location within the well bore. This location may be relative to a formation, to a previously drilled well bore, or to a previously conducted well operation. For example, it is important to know the depth of a previous well operation. However, measurements from the surface are imprecise. Although it is typical to count the sections of pipe in the pipe string as they are run into the borehole to determine the depth of a well tool mounted on the end of the pipe string, the length of the pipe string may vary due to stretch under its own weight and will also vary with downhole temperatures. This variance is magnified when the pipe string is increased in length, such as several thousand feet. It is not uncommon for the well tool to be off several feet when depth is measured from the surface.

In completions it is known to use a no-go ring in the casing string to set a depth location in a well. A typical no-go ring is a thin shouldered device disposed within the casing string which has an inside diameter approximating the drift diameter of the casing string. No-go rings are used to engage and stop the passage of a well tool being run through the well bore. The annular shoulder of a no-go ring is approximately $1/16^{th}$ of an inch thick on each side so that it will engage the well tool. Other well tools with a smaller diameter are allowed to pass through the no-go ring.

Many well operations require locating a particular depth and azimuth in the borehole for well operations. One such well operation is the drilling of one or more lateral boreholes. One typical sidetracking operation for drilling a lateral wellbore from a new or existing wellbore includes running a packer or anchor into the wellbore on wireline or on coiled tubing and then setting the packer or anchor within the wellbore. The packer or anchor is set at a known depth in the well by determining the length of the wireline or coiled tubing run into the wellbore. A second run or trip is made into the wellbore to determine the orientation of the packer or anchor. Once this orientation is known, a latch and whipstock are properly oriented and run into the wellbore during a third trip wherein the latch and whipstock are seated on the packer or anchor. One or more mills are then run into the wellbore on a drill string to mill a window in the casing of the wellbore. The whipstock is then retrieved. Subsequent trips into the wellbore may then be made to drill the lateral borehole to install a deflector or other equipment for down hole operations.

Further, in conventional sidetracking operations, although the depth of the packer or anchor used to support the whipstock is known, the orientation of the packer or anchor within the wellbore is not known. Thus, a subsequent trip must be made into the wellbore to determine the orientation of the packer or anchor using an orientation tool. The packer or anchor has a receptacle with an upwardly facing orienting surface which engages and orients the orientation tool stabbed into the packer or anchor. The orientation tool then determines the orientation of the packer or anchor within the wellbore. Once the orientation of the packer or anchor has been established, the orientation of the latch, whipstock and mill to be subsequently disposed in the wellbore is then adjusted at the surface so as to be properly oriented when run into the wellbore. The latch, whipstock and mill are then run into the wellbore and stabbed and latched into the packer or anchor such that the face of the whipstock is properly directed for milling the window and drilling the lateral borehole.

Since the packer or anchor are not oriented prior to their being set, the receptacle having the orienting surface and a mating connector may have an orientation that could lead to the receptacle being damaged during future operations. If the receptacle is damaged too badly, then it will not be possible thereafter to use it for orientation and latching of a subsequent well operation.

It is preferred to avoid numerous trips into the wellbore for the sidetracking operation. A one trip milling system is disclosed in U.S. Pat. Nos. 5,771,972 and 5,894,889. See also, U.S. Pat. No. 4,397,355.

In a sidetracking operation, the packer or anchor serves as a downhole well tool which anchors the whipstock within the cased borehole against the compression, tension, and torque caused by the milling of the window and the drilling of the lateral borehole. The packer and anchor have slips and cones which expand outward to bite into the cased borehole wall to anchor the whipstock. A packer also includes packing elements which are compressed during the setting operation to expand outwardly into engagement with the casing thereby sealing the annulus between the packer and the casing. The packer is used for zone isolation so as to isolate the production below the packer from the lateral borehole.

An anchor without a packing element is typically used where the formation in the primary wellbore and the formation in the lateral wellbore have substantially the same pressure and thus the productions can be commingled since there is no zone pressure differentiation because the lower zone has substantially the same formation pressure as that being drilled for the lateral. In the following description, it should be appreciated that a packer includes the anchoring functions of an anchor.

The packer may be a retrievable packer or a permanent big bore packer. A retrievable packer is retrievable and closes off the wellbore while a permanent big bore packer has an inner mandrel forming a flowbore through the packer allowing access to that portion of the wellbore below the packer. The mandrel of the big bore packer also serves as a seal bore for sealing engagement with a another well tool, such as a whipstock, bridge plug, production tubing, or liner hanger. The retrievable packer includes its own setting mechanism and is more robust than a permanent big bore packer because its components may be sized to include the entire wellbore since the retrievable anchor and packer does not have a bore through it and need not be a thin walled member.

One apparatus and method for determining and setting the proper orientation and depth in a wellbore is described in U.S. Pat. No 5,871,046. A whipstock anchor is run with the casing string to the desired depth as the well is drilled and the casing string is cemented into the new wellbore. A tool string is run into the wellbore to determine the orientation of the whipstock anchor. A whipstock stinger is oriented and disposed on the whipstock at the surface, and then the assembly is lowered and secured to the whipstock anchor. The whipstock stinger has an orienting lug which engages an orienting groove on the whipstock anchor. The whipstock stinger is thereby oriented on the whipstock anchor to cause the face of the whipstock to be positioned in the desired direction for drilling. The whipstock stinger may be in two parts allowing the upper part to be rotated for orientation in the wellbore. The method and apparatus of U.S. Pat. No. 5,871,046 is limited to new wells and cannot be used in existing wells since the whipstock anchor must be run in with the casing and cannot be inserted into an existing wellbore.

U.S. Pat. No. 5,467,819 describes an apparatus and method which includes securing an anchor in a cased wellbore. The anchor may include a big bore packer. The wall of a big bore packer is roughly the same as that of a liner hanger. The anchor has a tubular body with a bore therethrough and slips for securing the anchor to the casing. The anchor is set by a releasable setting tool. After the anchor is set, the setting tool is retrieved. A survey tool is oriented and mounted on a latch to run a survey and determine the orientation of the anchor. A mill, whipstock, coupling and a latch or mandrel with orientation sleeve connected to the lower end of the whipstock are assembled with the coupling allowing the whipstock to be properly oriented on the orientation sleeve. The assembly is then lowered into the wellbore with a lug on the orientation sleeve engaging an inclined surface on the anchor to orient the assembly within the wellbore. The window is milled and then the lateral is drilled. If it is desirable to drill another lateral borehole, the whipstock may be reoriented at the surface using the coupling and the assembly lowered into the wellbore and re-engaged with the anchor for drilling another lateral borehole.

U.S. Pat. No. 5,592,991 discloses another apparatus and method for installing a whipstock. A permanent big bore packer having an inner seal bore mandrel and a releasable setting tool for the packer allows the setting tool to be retrieved to avoid potential leak paths through the setting mechanism after tubing is later sealingly mounted in the packer. An assembly of the packer, releasable setting tool, whipstock, and one or more mills is lowered into the existing wellbore. The packer may be located above or below the removable setting tool. A survey tool may be run with the assembly for proper orientation of the whipstock. A lug and orienting surface are provided with the packer for orienting a subsequent well tool. The packer is then set and the window in the casing is milled. The whipstock and setting tool are then retrieved together leaving the big bore packer with the seal bore for sealingly receiving a tubing string so that production can be obtained below the packer. One disadvantage of the big bore packer is that its bore size will not allow the subsequent smaller sized casing to be run through its bore.

U.S. Pat. No. 5,592,991 describes the use of a big bore packer as a reference device. However, once the releasable setting tool and whipstock are removed from the big bore packer, the packer no longer has sealing integrity. The big bore packer only seals the wellbore after another assembly is lowered into the well and a stinger is received by the big bore. packer to create or establish sealing integrity. The big bore packer does double duty, first it serves as the anchor for the milling operation and then it becomes a permanent packer to perform the completion.

In both the '891 and '991 patents, the whipstock assembly must latch into the packer or anchor to anchor the whipstock and withstand the compression, tension, and torque applied during the milling of the window and the drilling of the lateral borehole. Further, the use of a big bore packer requires a packer assembly which can withstand a 5,000 psi pressure differential and thus all of its components must have a minimum 5,000 psi burst and collapse capability.

The big bore packer has the additional disadvantage of having a mandrel extending through it and on which is mounted the cones for activating the slips of the packer. The mandrel is subsequently used as a seal bore which is then used for sealing with a tubing string. This mandrel is not only an additional mechanical part but requires a reduction in the diameter of the bore of the packer.

The present invention overcomes the deficiencies of the prior art.

SUMMARY OF THE INVENTION

The well reference apparatus and method of the present invention includes a reference member permanently installed within the borehole at a preferred depth and orientation in the well. The reference member provides a permanent reference for the depth and orientation of all well operations, particularly in a multi-lateral well. The assembly of the present invention includes disposing a landing sub, setting member, and reference member on the end of a pipe string. An orienting tool such as an MWD collar is disposed in the pipe string above the landing sub. This assembly is lowered into the borehole on the pipe string. Once the preferred depth is attained, the MWD collar is activated to determine the orientation of the reference member. If the reference member is not oriented in the preferred direction, the pipe string is rotated to align the reference member in the preferred direction. This process is repeated for further corrective action and to verify the proper orientation of the reference member. Upon achieving the proper orientation of the reference member, the reference member is set within the borehole and the pipe string is disconnected from the reference member and the setting member is retrieved. The pipe string may also include a well tool for performing a drilling operation in the borehole.

The present invention features apparatus and methods that permit multiple sidetracking-related operations to be performed using fewer runs into the wellbore. The reference member is placed in the wellbore during the initial trip into the wellbore, and remains there during subsequent operations. Further, the reference member provides a receptacle for reentry runs into the well.

In another aspect, the invention provides for all of the apparatus used during subsequent sidetracking operations to be commonly oriented using only a single orientation on the reference member.

The well reference apparatus and method may be used in a sidetracking operation and include the reference member disposed on setting member, a packer or anchor, a whipstock, a mill assembly, and an orientation device, such as an MWD collar and bypass valve, disposed above the mill assembly in a pipe string extending to the surface. The entire assembly is lowered into the borehole in one trip into the well. Once the reference member has reached the desired depth, fluid flows through the MWD collar allowing the MWD collar to determine and communicate the orientation of the reference member within the borehole. As previously described, the pipe string may be rotated to adjust the orientation of the reference member until the desired orientation is achieved. Once the orientation is complete, the bypass valve is closed and the setting tool is actuated hydraulically to set the reference member permanently within the casing of the borehole. The anchor or packer is then set. A packer is preferred which sealingly engages the wall of the casing. Once the anchor is set, the mill assembly is released from the whipstock and a window is milled through the casing and into the formation.

In another embodiment of the method, an assembly is provided for drilling another lateral borehole spaced out from an earlier lateral borehole. This assembly includes a locator sub, a string of spacer subs extending from the locator sub to a retrievable packer which supports a whipstock and mill assembly. No orientation member is required since the assembly is oriented on the reference member. The retrievable packer supports the upper end of the assembly within the borehole to prevent the instability of the milling and drilling operations on the whipstock.

It should also be appreciated that the reference member has a through bore permitting the performance of operations in that portion of the borehole below the reference member.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 6 is a cross-sectional view of the assembly of FIGS. 2A–B with the slips of the reference member in the set or engaging position;

FIG. 7 is a cross-sectional elevation view of the assembly of FIGS. 2A–B with the actuation pistons having been actuated to shear the connection between the setting tool and reference member;

FIG. 8 is a cross-sectional elevation view of the assembly of FIGS. 2A–2B with the release dogs of the setting tool in their release position;

FIG. 9 is a cross-sectional elevation view of the setting tool being retrieved from the reference member;

FIGS. 15A–D are cross-sections of the present invention lowered and oriented on the reference member for cutting another window and drilling another lateral borehole in the formation using the reference member of the present invention; and FIGS. 16A–C are cross-sections of the present invention lowered and oriented on the reference member for installing a tie-back insert in a lateral borehole using the reference member of the present invention.

DETAILED DESCRIPTION OF THE PREFERRED EMBODIMENTS

Figure 1:
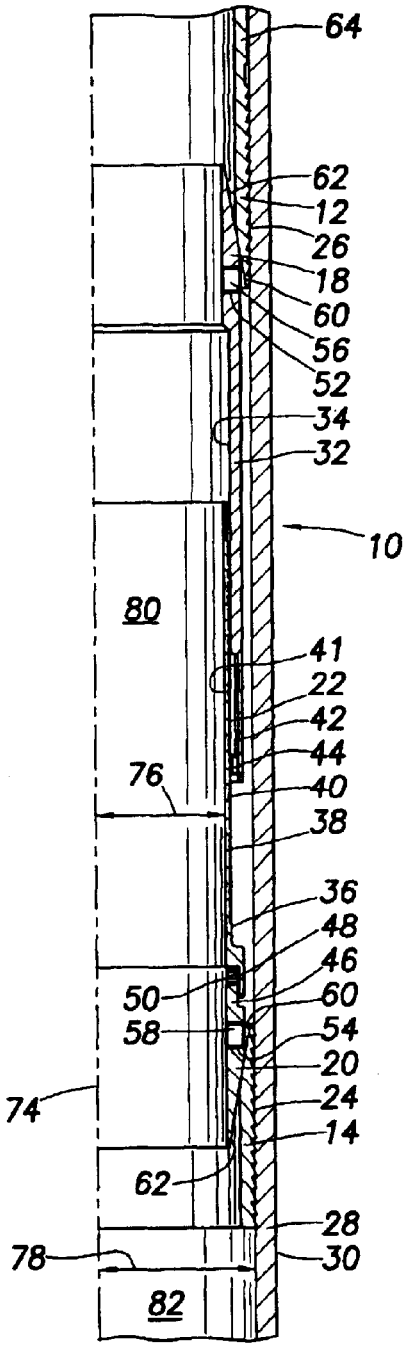
FIG. 1 is a cross-sectional elevation view of a preferred embodiment of the reference member of the present invention installed within a casing string in a well bore.

Referring initially to FIG. 1, there is shown a preferred reference member 10 of the present invention disposed within a casing string 28 in a borehole 30. Reference member 10 is a depth locator and an angular orientor having a known depth and angular orientation within cased borehole 30. The reference member 10 is neither a packer nor an anchor because it neither seals with the casing 28 nor serves as an anchor to withstand the compression, tension, and torque caused during a well operation. A packer or anchor is typically used in conjunction with the reference member 10. The reference member 10 is completely divorced from the packer or anchor and is used only for depth location and orientation. As will be more fully hereinafter described, once reference member 10 is set within casing 28, it serves both as a reference for depth and a reference for angular orientation within the well bore 30.

In using the terms "above", "up", "upward", or "upper" with respect to a member in the well bore, such member is considered to be at a shorter distance from the surface through the bore hole 30 than another member which is described as being "below", "down", "downward", or "lower". "Orientation" as used herein means an angular position or radial direction with respect to the axis of the borehole 30. In a vertical borehole, the orientation is the azimuth. The depth is defined as that distance between the surface of the cased borehole 30 and the location of the reference member 10 within the cased borehole 30. "Drift diameter" is a diameter, which is smaller than the diameter of the casing 28 taking into account the tolerance of the manufactured casing, through which a typical well tool will safely pass. Typically the drift diameter is approximately ⅛ inch smaller than the normal diameter of the casing 28.

The term "packer" and "anchor" as used herein are defined as a downhole well tool which anchors another well tool within the cased borehole to withstand the compression, tension, and torque caused during a well operation. The packer and anchor have slips and cones which expand outward to bite into the cased borehole wall to anchor another well tool. A packer differs from an anchor in that a packer includes packing elements which expand outwardly into sealing engagement with the casing to seal the annulus between the mandrel of the packer and the casing. Where the well tool is a whipstock or deflector, the packer and anchor anchors the whipstock against the compression, tension, and torque caused by the milling of the window in the casing and the drilling of the lateral borehole.

It is intended that the reference member 10 be permanently installed within the borehole 30. Permanent is defined as the reference member 10 being maintained in the cased borehole 30 at least throughout drilling operations. It should be appreciated that the reference member 10 may be retrievable.

Figure 2A:
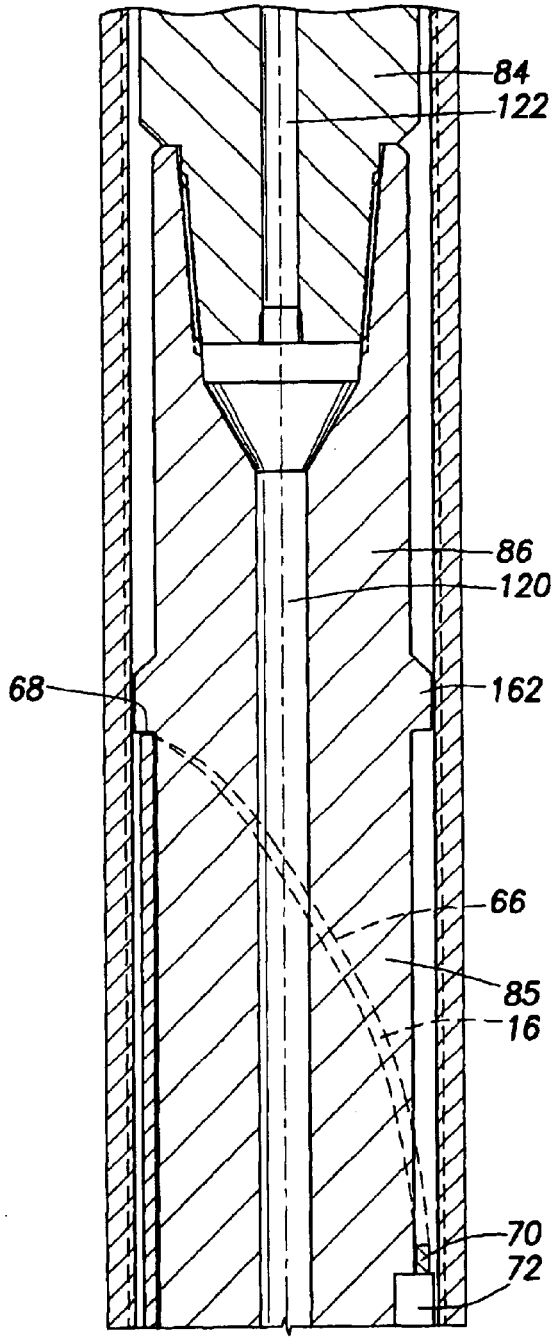
FIGS. 2A and 2B are cross-sectional elevational views of the reference member of FIG. 1 and a setting tool disposed within the reference member to actuate the reference member into engagement with the casing.
Figure 2B:
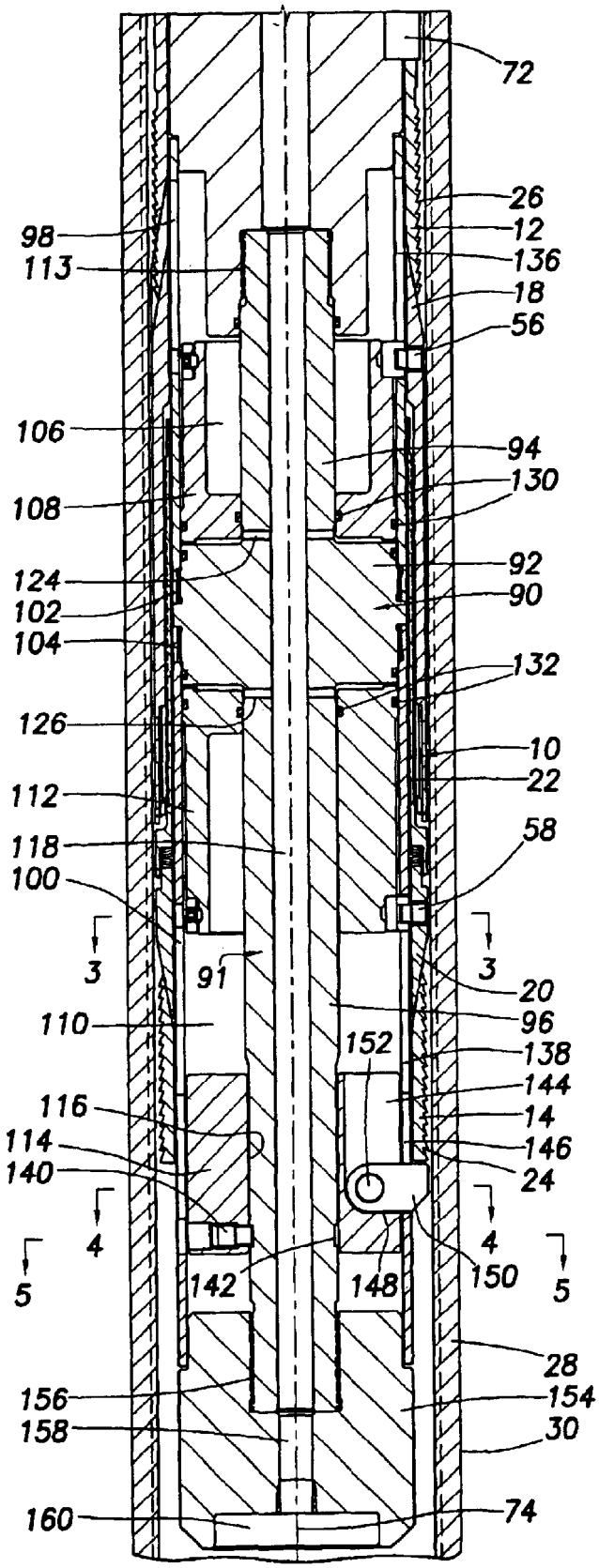
Figure 3:
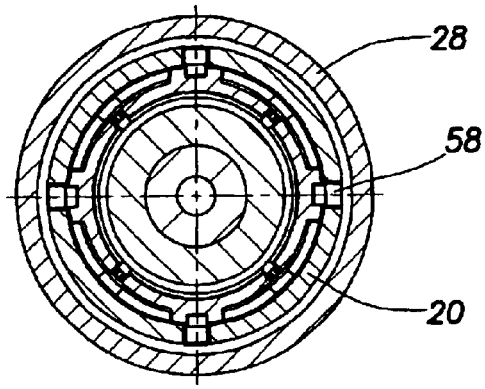
FIG. 3 is a cross-sectional view taken at plane A—A in FIG. 2B.

Referring particularly to FIG. 1 and FIGS. 2A–B, the reference member 10 includes upper and lower slips 12, 14, an orientation member 16, upper and lower cones 18, 20, and a ratchet ring 22. Reference member 10 is preferably made of steel. In one embodiment, upper and lower slips 12, 14 include teeth 24, 26, respectively, which bitingly engage the interior wall of casing 28 previously installed in the well bore 30. The slips 12, 14 are split annular members which are collapsed in their contracted position shown in FIGS. 2A and B and then are expanded to their expanded position upon the reference member 10 being set within casing 28 as shown in FIG. 1. The upper and lower slips 12, 14 have a diameter which is actually greater than the inner diameter of casing 28. As shown in FIG. 1, upon slips 12, 14 being expanded into biting engagement with the inside diameter of casing 28, there is substantially complete wall contact between slips 12, 14 and casing 28.

Upper and lower slips 12, 14 and upper and lower cones 18, 20 have cooperating wedge surfaces 60, 62 causing upper and lower slips 12, 14 to expand into biting engagement with casing 28 as upper and lower slips 18, 20 move away from each other, i.e. lower cone 20 moving downwardly and upper cone 18 moving upwardly against upper and lower slips 12, 14. Although upper and lower slips 12, 14 are shown as split annular members, it should be appreciated that upper and lower slips 12, 14 may include slip segments mounted within windows cut in a mandrel member thereby allowing the slip segments to expand and contract within the mandrel windows. Optionally, shear bolts may be provided to hold upper and lower slips 12, 14 in position until actuated into their expanded position. The actuation shears the shear bolts allowing upper and lower slips 12, 14 to expand outwardly.

The upper cone member 18 includes a full annular body 32 having an inner reduced diameter portion 34 in which is received a full annular member 36 of lower slips 20. Lower annular member 36 has an outer reduced diameter 38 with wickers 40 cut in the outer surface of member 36. Ratchet ring 22 is a split ring which includes inner ratchet teeth 41 for engaging wickers 40. Upper body 32 includes a further inner reduced diameter portion 42 in which is mounted ratchet ring 22 and retained thereon by a threaded retainer ring 44. As lower annular member 36 is received within the reduced diameter portion 34 of upper cone member 32, the ratchet teeth 41 of ratchet ring 22 engage wickers 40. Ratchet teeth 41 and wickers 40 only allow upper and lower cones 18, 20 to move away or separate from each other and do not permit them to move towards or collapse towards each other thereby maintaining upper and lower slips 12, 14 in the engaged position as hereinafter more fully described. The wickers 40 are lengths of thread-like members which are tapered in only one direction. Thus, the engagement between ratchet ring 22 and wickers 40 of annular member 36 only allows annular member 36 to move in one direction with respect to upper cone member 32. As cones 18, 20 move apart, ratchet ring 22 and wickers 40 prevent upper and lower cones 18, 20 from moving to a contracted position.

Referring now to FIGS. 1, 2A–B, and 3, upper and lower cones 18, 20 further include an aperture 52, 54 for housing a shear member 56, 58. Upper cone 18 is integral with upper cone member 32. Lower cone 20, however, includes an inner reduced diameter annular portion 46 which is received within a counter bore 48 on the end of lower cone member 36. A plurality of Belville springs 50 are disposed between the bottom of counterbore 48 and the upper terminal end of reduced diameter portion 46 of lower cone 20. Belville springs 50 place a downward force against lower cone 20 and against lower slip 14. Belville springs 50 serve as an energy storing member whereby as lower slip 14 engages casing 28, Belville springs 50 tend to expand to take up any slack in the assembly of reference member 10. It should be appreciated that Belville springs 50 may not be required in certain assemblies.

The teeth 24, 26 of slips 12, 14, respectively, are only required to bite into casing 28 so as to maintain reference member 10 in position while locating and orienting the well tool. The biting engagement of slips 12, 14 prevent the reference member 10 from rotating about the axis 74 of casing string 28. Once the angular orientation member 16 is set, its rotation within casing 28 must be prevented to avoid changing the orientation reference. It is unnecessary for slips 12, 14 to have a biting engagement which is comparable to that of an anchor which must absorb the impact of the well operation. Although upper and lower slips 12, 14 do not include vertical serrations to assist in preventing rotation between reference member 10 and casing 28, it should be appreciated that vertical serrations or carbide buttons may be included on upper and lower slips 12, 14 to enhance the engagement between reference member 10 and casing 28. See for example U.S. patent application Ser. No. 09/302,738 filed Apr. 30, 1999, entitled Anchor System for Supporting a Whipstock.

The reference member 10 need only have a sufficient engagement with the casing 28 so as to accommodate the minimal compression and torque required during the depth location and orientation of another well tool. The reference member 10 is not required to withstand the compression, tension, and torque caused by the well operation, such as the milling of a window. An independent packer or anchor are provided above the reference member 10 to withstand the rigors of the well operation. In particular, the reference member 10 need not withstand any force required to shear off any shear connection in a well tool installed in the well bore 30. Further, the reference member 10 is not required to handle the torque transmission due to any down hole operation. The torque transmission is handled by a completely separate tool and independent with the reference member 10 being used purely for orientation and depth location.

The construction of reference member 10 need only have sufficient mechanical integrity to handle the location and orientation of the subsequent well tool or well assembly. It need not handle the rigors of the well operation since this will be handled by an independent packer or anchor which is disposed adjacent the reference member 10.

Further since the reference member 10 is not be required to withstand the compression, tension, and torque of the well operation, the reference member 10 is not latched to the well tool or well assembly during the well operation and thus the reference member 10 does not require a latch. The reference member 10 might be termed an insertable locator tool. So long as the reference member is not used as an anchor for the well operation, no latch is required. The reference member 10 merely engages the well tool assembly. Still further reference member 10 does not seal with the casing 28 and thus does not require any packing elements so as to serve as a packer.

The upper slip 12 includes an upwardly extending annular body 64 forming orientation member 16. Orientation member 16 includes an inclined surface 66 extending from an upper apex 68 to a lower slot 70. Orientation member 16 is sometimes referred to as a muleshoe. Although orientation member 16 is shown as having an orientation surface 66 and slot 70 for receiving an orientation key on a well tool, it should be appreciated that the inclined surface 66 and slot 70 may be included on the well tool with the orientation key being the orientation member disposed on upper slip 12.

The reference member 10 has a central bore 80 therethrough with a diameter which is preferably only slightly greater than the drift diameter. A slightly smaller inside diameter is required of the reference member because of the orientation member 16 which must engage an orientation key 72 of the well tool assembly. Bore 80 of reference member 10 preferably has a minimum diameter of at least 4 inches. If the reference member 10 were used strictly as a depth locator, then orienting surface 66 and slot 70 could be eliminated allowing the inside diameter of bore 80 of reference member 10 to approximate the drift diameter.

The inside radius 76 of the bore 80 of reference member 10 in the set position shown in FIG. 1 is maximized with respect to the inside radius 78 of casing string 28. For example, it is typical to have a 7 inch casing as the innermost casing string in the well bore. A 7 inch casing has an inside diameter of approximately 6 inches and in a 7 inch casing, the bore 80 of the reference member 10 has a inside diameter of at least 5 inches which is only one inch smaller than the diameter of casing 28. More preferably bore 80 has a diameter of 5½ inches which is only ½ inch smaller than the diameter of casing 28. It is preferred that the diameter of bore 80 be no less than ¾ inch smaller than the diameter of casing 28. This will allow a 4½ liner with 5 inch couplings to pass through reference member 10.

Bore 80 of reference member 10 is sufficiently large to allow the next standard sized liner or casing string to pass therethrough. For example, if casing 28 were a 7 inch casing, the next standard size pipe would be 4½ inch pipe such as a liner. In comparison, a 7 inch big bore packer has a throughbore of less than 4 inches and will not allow the passage of 5 inch couplings or a 4½ inch liner. If a big bore packer were used, a reduced size liner would be required such as a 3½ inch liner so as to pass through the bore of the big bore packer. If casing 28 were 9⅝ inch casing, reference member 10 would have a nominal diameter of 8½ inches and would then accommodate a 7⅝ inch pipe. The diameter of bore 80 through reference member 10 would then preferably be between 7¾ and 8 inches.

It should be appreciated that the setting tool for the packer or anchor could also form a part of the setting tool for the reference member 10 and both be actuated simultaneously. This combination setting tool would then be retrieved with the packer or anchor. The combination setting tool would actuate two sets of slips, one set for the reference member and one set for the packer or anchor.

Referring particularly to FIGS. 2A–B, in addition to reference member 10, there is shown a setting member 90 for setting reference member 10 within casing 28. Reference member 10 is disposed on setting member 90 which in turn is supported on the lower end of an orienting member such as a landing sub 86 connected to a well tool 84 for performing a well operation. The landing sub 86 includes an extension member or stinger 85 which is received within bore 80 of reference member 10 with stinger 85 including reference key 72 to properly orient the well tool.

Setting member 90 includes an inner mandrel 91 having a full diameter portion 92 with upper and lower reduced diameter portions 94, 96. Upper and lower threaded sleeves 98, 100, respectively, are threadingly mounted at 102, 104, respectively, on full diameter portion 92. Upper outer sleeve 98 and upper inner mandrel 94 form an upper cylinder 106 in which is disposed an upper piston 108. Likewise, lower outer sleeve 100 and lower inner mandrel 96 form a lower cylinder 110 housing a lower piston 112. It should be appreciated that seals are provided on pistons 108, 112 such as 130, 132. Upper cylinder 106 is closed at its upper end by the threaded connection at 113 of stinger 85 of landing sub 86 and upper inner mandrel 94. A dog collar 114 with a bore 116 receives lower inner mandrel 96 and is sized to be received within lower outer sleeve 100 to close the lower end of lower cylinder 110. Inner mandrel 91 includes a central hydraulic passageway 118 extending the length thereof communicating with a similar hydraulic passageway 120 through the stinger 85 of landing sub 86 which in turn communicates with hydraulic passageway 122 extending through the well tool. Inner mandrel 91 also includes upper and lower ports 124, 126 communicating with that portion of upper and lower cylinders 106, 110 between pistons 108, 112 and full diameter portion 92 of mandrel 91.

On the outboard ends of pistons 108, 112, there are disposed shear members 56, 58, respectively. It can be seen that shear members 56, 58 are mounted on pistons 108, 112 by annular retainer members disposed on the outboard ends of the pistons 108, 112. Shear members 56, 58 extend radially outwardly through slots 136, 138 in upper outer sleeve 98 and lower outer sleeve 100. Thus, as pistons 108, 112 are actuated, their actuation causes upper and lower cones 18, 20 to move with pistons 108, 112.

Figure 4:
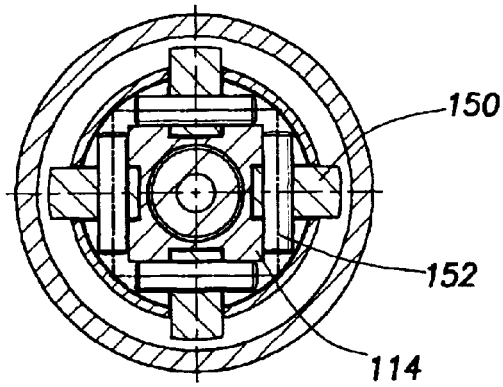
FIG. 4 is a cross-sectional view taken at plane B—B in FIG. 2B.
Figure 5:
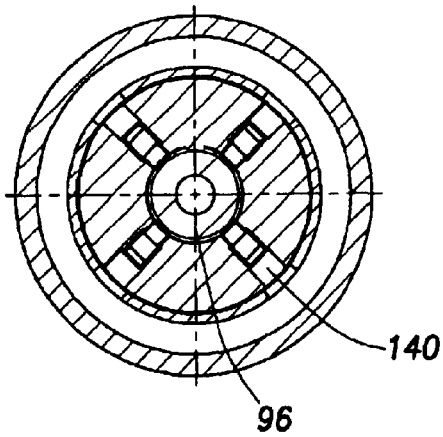
FIG. 5 is a cross-sectional view taken at plane C—C in FIG. 2B.

Referring now to FIGS. 2B, 4 and 5, dog collar 114 includes a shear connection 140, such as a ring with a shear screw, extending through the wall of collar 114 and into an annular groove 142 around lower inner mandrel 96. FIG. 5 shows the shear connection between dog collar 114 and lower inner mandrel 96. Dog collar 114 includes an outwardly facing pocket 144 in the wall thereof in which is pivotally housed one or more dogs 150. Dog 150 is pivotably mounted on a pivot pin 152 and is sized to be received within pocket 144. Dog 150 has a radially extending outer and engaged position extending through a window portion 146 of sleeve 138 as shown in FIG. 2B. In the outer and engaged position, dog 150 rests and is supported by the bottom 148 of pocket 144 and the lower end of window 146. As shown in FIG. 2B, in the outer and engaged position of dog 150, dog 150 extends below the lower terminal end of lower slip 14 so as to ensure the retainage of slip 14 around the lower outer sleeve 100.

A cap 154 is threaded at 156 to the lower end of inner lower mandrel 96 to close hydraulic passageway 118 and to retain dog collar 114 within lower outer sleeve 100. Cap 154 may also include a bore extension 158 and a closure cap 160 for access to hydraulic passageway 118.

As shown in FIGS. 2A and B, reference member 10 is mounted around setting member 90 with dog 150 supporting lower slip 14. The orientation member 16 extending from upper slip 12 receives an orientation key 72 on the lower end of landing sub 86 for orienting the well tool. An annular stop shoulder 162 is provided on stinger 85 of sub 86 so as to provide a downwardly facing stop surface on the upper apex 68 of orientation member 16.

Referring now to FIGS. 6–9, there is shown the staged setting operation of reference member 10 and the releasing of setting member 90. Although the actuation of reference member 10 is described as a hydraulic actuation, it should be appreciated that there are other methods of actuation other than hydraulic actuation such as mechanical actuation. One type of mechanical actuation includes releasing a trigger on a pre-energized actuator which then causes slips 12, 14 to expand into biting engagement with casing 28.

Referring now to FIG. 6, for the hydraulic actuation of upper and lower slips 12, 14, fluid pressure is applied through hydraulic passageway 118 from the surface. This fluid pressure is applied through upper and lower hydraulic ports 124, 126 and into that portion of cylinders 106, 110 between the heads of upper and lower pistons 108, 112 and the full diameter portion 92 of mandrel 91. As shown in FIG. 6, this fluid pressure causes pistons 108, 112 to move away from annular portion 92 of mandrel 91. Since pistons 108, 112 are attached to upper and lower cones 18, 20 by shear members 56, 58, respectively, as pistons 108, 112 move, so do upper and lower cones 18, 20. Thus, upper and lower pistons 108, 112 move upwardly and downwardly, respectively, such that upper and lower cones 18, 20 cause wedge surfaces 60, 62 to cam upper and lower slips 12, 14 outwardly into engagement with casing 28. As upper and lower cones 18, 20 separate, ratchet ring 22 maintains their separation by means of engagement of ratchet teeth 41 and wickers 40.

Referring now to FIG. 7, all of the load caused by the hydraulic actuation of upper and lower slips 12, 14 is carried through shear members 56, 58. Upon upper and lower slips 12, 14 reaching through outermost biting engagement with casing 28, further hydraulic pressure is applied causing shear members 56, 58 to reach their shear value and shear the connections between the setting member 90 and reference member 10. Members 56, 58 separate into two components 56A, 56B and 58A, 58B, respectively, following shearing operation. Upper piston 108 continues its upward movement until it engages the lower end of landing sub 86 and the lower piston 112 continues its downward movement until it engages dog collar 114.

Referring now to FIG. 8, after shear connections 56, 58 are sheared and pistons 108, 112 reach the limits of their travel, further hydraulic pressure is applied causing lower piston 112 to apply additional force on dog collar 114 until that force causes the shear connection 140, best shown in FIG. 2B, to shear allowing a further downward movement of lower piston 112 thereby moving dog collar 114 downwardly against lower cap 154. Dog collar 114 serves as a bulkhead member. As dog collar 114 moves downwardly, the lower end 164 of window 146 in sleeve 100 causes dog 150 to pivot inwardly into pocket 144. As dog 150 is cammed to rotate upwardly and inwardly in a clockwise direction, it folds inwardly to clear the lower end of slip 14 and cone 20.

Referring now to FIG. 9, once dog 150 is rotated inwardly, setting member 90 is now disconnected from reference member 10. The setting member 90 may now pass through bore 80 of reference member 10 and be retrieved. Since dog 150 merely holds lower slip 14 onto reference member 10, once lower slip 14 is expanded and bites into casing 28, dog 150 is no longer required since dog 150 holds no load after slip 14 bites into casing 28.

It is preferred that the reference member 10 be permanently installed prior to the initial drilling operation in the cased borehole 30, thus becoming the universal reference for all subsequent drilling operations. The location of all subsequent drilling operations then becomes relative to the permanent reference point provided by the reference member 10. The reference member 10 becomes a marker and an orienting locator for subsequently used well tools.

Typically, the reference member 10 is less than a few hundred feet from the last well operation and thus any deviation from reference member 10 is small compared to the deviation from the surface. The use of the reference member 10 as the reference point for all drilling operations allows those drilling operations to be precisely located relative to each other as well as relative to the reference member 10. Thus, the reference member 10 does not determine absolute depth from the surface but relative depth.

Once the reference member 10 is set, all subsequent drilling operations are performed relative to that fixed depth within the cased borehole 30. For example, in the placement of individual lateral boreholes, each of the lateral boreholes is located relative to the reference member 10. In particular, the location of the individual lateral boreholes is not determined relative to the surface. As a further example, the assemblies for performing individual drilling operations are landed and oriented with respect to the reference member 10. Since each of these assemblies has a known length, the individual drilling operations performed by these assemblies is known and thus the absolute distance between the reference member 10 and an individual lateral borehole is also known. Thus, the reference member is used to space out all future drilling operations and thus conduct those operations at a specific location.

It should be appreciated that any well tool may be disposed and oriented on reference member 10. By way of example, typical well tools include a setting tool, hinge connector, whipstock, latch mechanism, or other commonly used well tools for drilling operations. The reference member 10 becomes a marker and an orienting locator for subsequently used well tools.

It is preferred that the reference member 10 be installed in one trip into the borehole. A trip is defined as lowering a string of pipe or wireline into the borehole and subsequently retrieving the string of pipe or wireline from the borehole. A trip may be defined as a tubing conveyed trip where the well tool is lowered or run into the well on a pipe string. It should be appreciated that the pipe string may include casing, tubing, drill pipe or coiled tubing. A wireline trip includes lowering and retrieving a well tool on a wireline. Typically a wireline trip into the hole is preferred over a tubing conveyed trip because it requires less time and expense.

The reference member 10 not only locates the well tool at a known depth but also orients subsequently installed well tools within the borehole. In particular, the orienting surface 66 on orientation member 16 guides the landing sub 86 attached to the well tool to a known orientation within the borehole 30. It should be appreciated that the orienting member 16 of the reference member 10 may include various types of orienting surfaces including orienting surface 66 with slot 70 or an orientation key similar to key 72. In the present invention, it is preferred that the reference member 10 include orienting surface 66 which engages an orientation key 72. However, it should be appreciated that the reference member 10 may include the key 72 and not orienting surface 66 so as to avoid the collection of debris which falls into the borehole and which might ultimately block the orienting surface 66 and orientation slot 70. It should further be appreciated that the orientation member 16 of reference member 10 may be any device which will allow alignment with a member stabbing into reference member 10.

Although the reference member 10 has been described for use both as a depth locator and angular orienter, it should be appreciated that the angular orientor feature may not be required in certain operations such that the reference member 10 would not include an inclined surface 66 and orientation slot 70, for example, but may only include an upwardly facing annular shoulder to engage a similar shoulder on a landing sub so as to locate the well tool at a predetermined depth within the well bore. For example, note annular shoulder 162 on landing sub 86. Where the reference member is only used to locate a predetermined depth in the well, the reference member may be described as an insertable no-go member. If orientation were later required, a well tool may be landed on the insertable reference member. A survey tool may then used to orient the well tool and landing sub to determine the proper orientation within the well bore for a packer or anchor, for example, which is then set in the casing. The insertable reference member again would not serve as either a packer or anchor and would only prevent a well tool from passing further into the well bore. It would also not prevent any rotation of the well tool.

It should be appreciated that there are many orientating tools and methods well known in the art for determining the orientation of reference member 10. Such prior art orientating tools and methods may be used with the well reference apparatus and method of the present invention. It is preferred that the reference member be oriented in a preferred orientation within the cased borehole. Thus, it is preferred that once the reference member is located at a preferred depth within the cased borehole, that the orienting tool be used to determine the orientation of the reference member 10. For example, in a horizontal well, it is preferred that the reference member be located on the high side of the borehole and project downwardly so as to avoid becoming an interference with any tools which are run through the through bore of the anchor member.

Various orienting tools and methods may be used to determine the orientation of the reference member 10. One common method is the use of a measurement while drilling ("MWD") tool. Various types of MWD tools are known including, for example, a magnetometer which determines true north. Typically, a bypass valve is associated with the MWD tool since the MWD tool typically requires fluid flow for operation. Fluid flows through the MWD tool and then back to the surface through the bypass valve allowing the tool to conduct a survey and determine its orientation within the drill string or cased borehole. Since the orientation of the MWD tool is known with respect to the reference member 10, a determination of the orientation of the MWD tool also provides the orientation of the reference member 10.

In one preferred method of the well reference apparatus and method of the present invention, the reference member 10 is disposed on the end of a pipe string with an MWD collar disposed on the pipe string above the reference member 10. In operation, the assembly is lowered into the borehole on the pipe string. Once the preferred depth is attained, the MWD is activated to determine the orientation of the reference member 10. If the reference member 10 is not oriented in the preferred orientation, the pipe string is rotated to align the reference member in the preferred orientation. This process may be repeated for further corrective action and to verify the proper orientation of the reference member 10. Upon achieving the proper orientation of the reference member 10, the reference member 10 is set within the borehole 30 and the pipe string disconnected from the reference member 10 and retrieved. It should be appreciated that the pipe string may also include a well tool for performing a well operation in the borehole 30. The well tool would preferably be disposed between the MWD collar and the reference member 10.

In an alternative preferred method, the well reference apparatus and method includes an assembly of the reference member 10 on the lower end of a pipe string. The assembly is lowered into the well until the desired depth is achieved. An orienting tool, such as wireline gyro is lowered through the bore of the pipe string and oriented and set within the reference member 10. The orienting tool determines the orientation of the reference member 10. If the reference member 10 does not have the desired orientation, the pipe string is rotated to the desired orientation of the reference member 10. The orienting tool may be used to take further corrective action or to verify the orientation of the reference member 10. Once the orientation of the reference member has been achieved, the wireline orienting tool is retrieved from the well. It can be appreciated by one skilled in the art that a well tool for a well operation may also be disposed in the pipe string. It can be seen that this embodiment requires both a tubing conveyed trip and a wireline trip into the well.

It should be appreciated, however, that the reference member 10 may be set within the cased borehole 28 and then its orientation determined by an appropriate orientation measuring tool. For example, the reference member 10 may be lowered into the well on a wireline and wireline set within the cased borehole. A wireline gyro may then be lowered into the borehole and orientingly received by the reference member 10 to determine the actual orientation of the reference member within the borehole. The orientation member 16 on the reference member 10 receives landing sub 86 with orientation key 72 connected to a wireline gyro or other orientation device. The orientation member 16 orients the gyro in a predetermined orientation such that upon the gyro determining its orientation within the cased borehole 28, the orientation of the reference member 10 is also known. The MWD tool is preferred over the wireline gyro in a horizontal borehole where there is no gravity to assist the gyro to pass down through the cased borehole 28. As can be appreciated, this requires an additional trip into the well and may or may not achieve a desired angular orientation of the reference member within the borehole.

Preferably, the setting tool 90 is assembled onto the reference member 10 at the surface. The setting tool 90 is connected to the landing sub 86 with orientation key 72 which engages the orientation surface 66 and slot 70 on the orientation member 16 on the reference member 10. This engagement aligns the setting tool 90 with the reference member 10 for orienting and mating the key 72 with orientation slot 70 on the reference member 10. Thus, the setting tool 90 is oriented in a specific manner with respect to the reference member 10 prior to being lowered into the well bore 30.

Although not preferred, it should be appreciated that the setting tool may remain attached to the reference member.

However, to achieve the full advantages of the present invention, if the setting tool is to remain attached to the reference member 10, it is preferred that the setting tool include a through bore which does not restrict the passage of production fluids and well tools.

It should further be appreciated that the reference member 10 may be mounted below a retrievable packer to form a two-stage packer. The upper stage of the packer with the sealing elements may be removed allowing the reference member to remain in the borehole.

It should also be appreciated that the reference member 10 may be adapted to also serve as an anchor or as a packer. See U.S. Provisional Application Serial No. 60/134,799, filed May 19, 1999 and entitled "Well Reference Apparatus and Method," hereby incorporated herein by reference.

It should be appreciated that the well reference apparatus and method may be used with many types of well tools used for accomplishing a drilling operation in a well and in particular for multi-lateral drilling operations. For example, such well tools may include a whipstock, a deflector, a sleeve, a junction sleeve, a multi-lateral liner, a liner, a spacer sub, an orientation device, such as an MWD or wireline gyro, or any other tool useful in drilling and completion operations.

The well reference apparatus and method is useful in the drilling of boreholes in new and existing wells and particularly is useful in the drilling of multi-lateral wells. Multi-lateral wells are typically drilled through an existing cased borehole where a lateral borehole is sidetracked through a window cut in the casing and then into the earthen formation. Multi-lateral wells include a plurality of lateral boreholes sidetracked through an existing borehole. The preferred embodiment will now be described for use in milling a window in the cased borehole and drilling a lateral borehole. It should be appreciated that this method is only one example of the well operations which may be conducted with the well reference apparatus and method of the present invention.

Referring now to FIGS. 10–14, the well reference apparatus and method of the present invention has particular application in drilling operations for the drilling of multiple lateral boreholes from an existing cased well. It should be appreciated that for reasons of clarity and simplicity not all details are shown in FIGS. 10–14, and details are only shown where necessary or helpful to an understanding of the invention. Standard fluid sealing techniques, such as the use of annular O-ring seals and threaded connections may be depicted but not described in detail herein, as such techniques are well known in the art. As such construction details are not important to operation of the invention, and are well understood by those of skill in the art, they will not be discussed here.

Figure 10A:
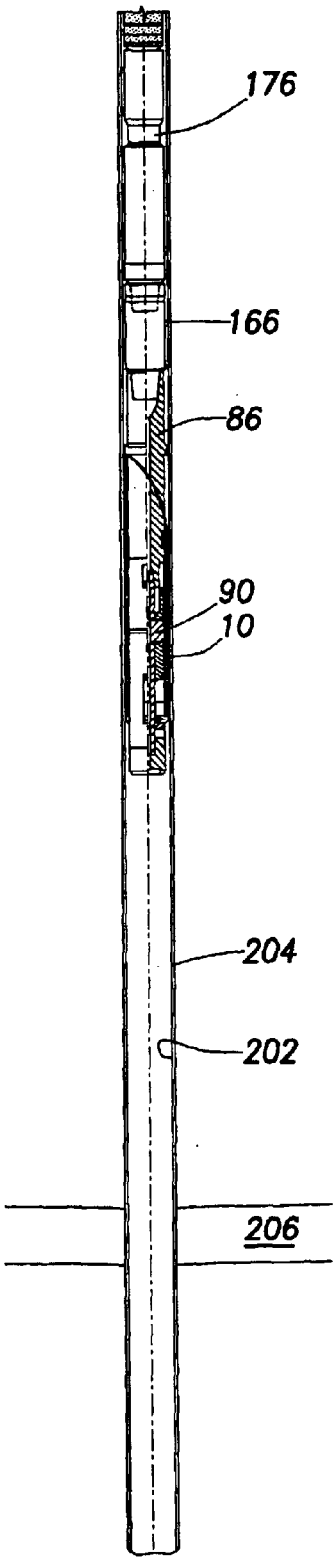
FIGS. 10A–10C are a cross-sectional elevation view of a well assembly including a reference member and setting tool mounted on a landing sub attached to a spline sub which in turn is connected to a retrievable packer and whipstock for running into the wellbore.
Figure 10B:
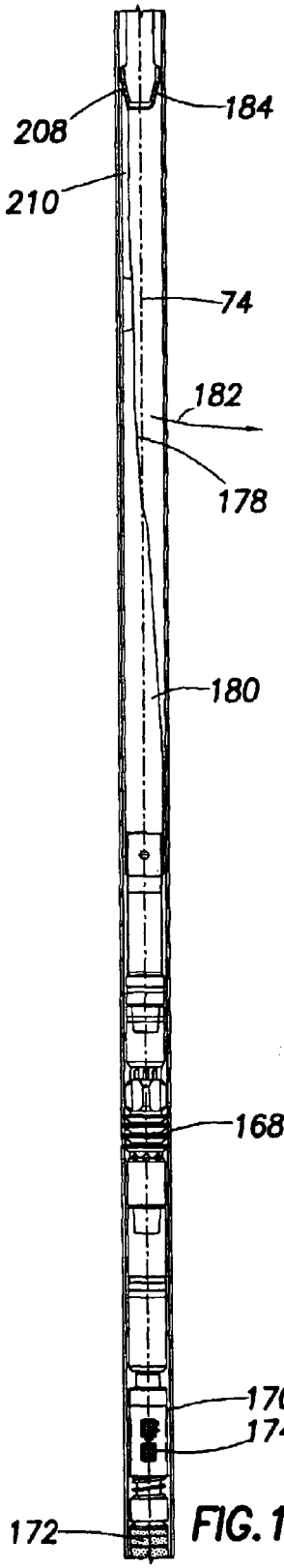
Figure 10C:
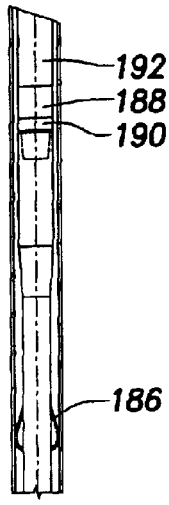

Referring now to FIGS. 10A–C, there is shown one preferred assembly 200 of the well reference apparatus and method disposed within an existing borehole 202 cased with casing 204. The cased borehole 202 passes through a formation 206. The assembly 200 includes reference member 10, a setting tool 90, a landing sub 86, a splined sub 166, a retrievable packer or anchor 170, a debris barrier 168 and a whipstock 180. The splined sub 166 orients the landing sub 86 with the packer or anchor 170. Typically a packer will be used rather than an anchor. Retrievable packer 170 is a standard retrievable packer such as that manufactured by Smith International, Inc. It should be appreciated that a retrievable packer 170 includes a packing element 172, one or more slips 174, and its own setting mechanism 176. Whipstock 180 is a standard whipstock such as the track master whipstock manufactured by Smith International, Inc. Whipstock 180 includes a guide surface 178 facing a predetermined direction 182.

In a one trip system, the assembly 200 further includes a plurality of mills, including a window mill 184 which is releasably attached at 208 to the upper end 210 of whipstock 180 and one or more additional mills 186. Mills 184, 186 may be a track master mill manufactured by Smith International, Inc. The assembly 200 also includes an MWD collar 188 and a bypass valve 190 disposed above the mills 184, 186. A pipe string 192 supports the assembly 200 and extends to the surface. Further details of the window milling system may be found in U.S. Pat. Nos. 5,771,972 and 5,894,88, both hereby incorporated herein by reference.

Alternatively, it should be appreciated that assembly 200 may be run into the well with a tubing conveyed trip and a wireline trip by replacing the MWD collar 188 with a locator sub for receiving a wireline gyro to determine the orientation of reference member 10.

It should be appreciated that assembly 200 is assembled with reference member 10, the whipstock face 178, and the MWD collar 188 angularly oriented in a known orientation, whereby upon the MWD determining its orientation within the borehole 202, the orientation of the reference member 10 and the whipstock face 178 is known. The whipstock face 178 may be aligned with landing sub 86 by splined sub 166. The splines on splined sub 166 also provide for the transmission of torque.

Figure 11A:
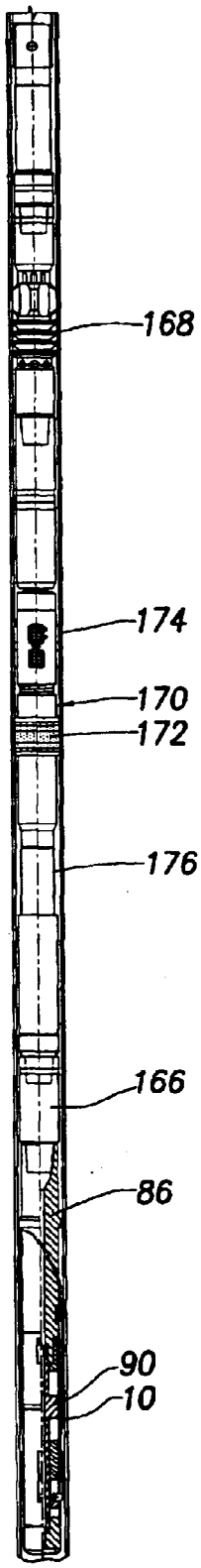
FIGS. 11A–C are a cross-sectional view of the assembly of FIGS. 10A–C with the retrievable packer in the set position.
Figure 11B:
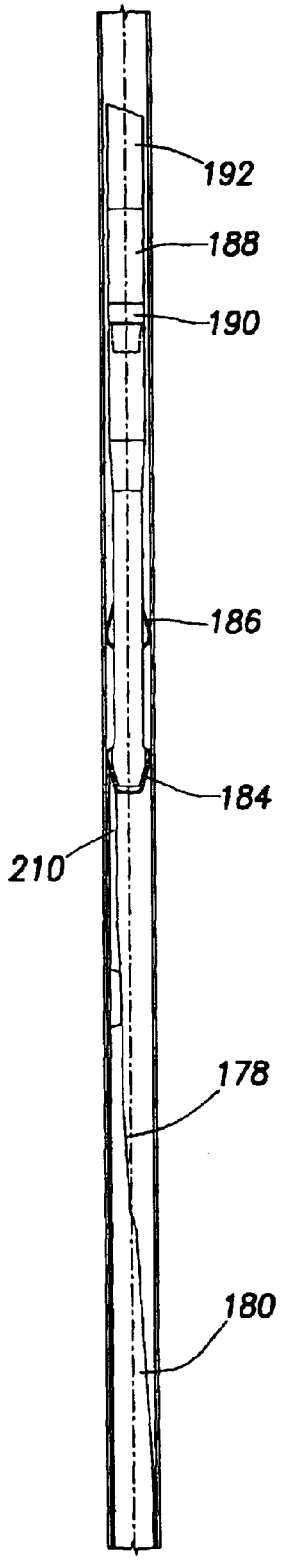
Figure 11C:
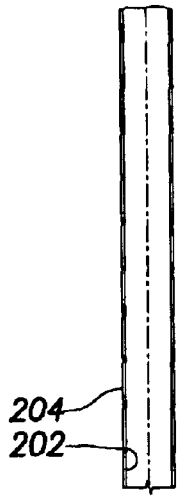

Referring now to FIGS. 11A–C, assembly 200 is preferably lowered into the borehole 202 in one trip into the well. Sections of pipe are added to pipe string 192 until reference member 10 reaches the desired depth within borehole 202. This depth may be determined by counting the sections of pipe in the pipe string 192 since each of the pipe sections has a known length. Once the reference member 10 has reached the desired depth, fluid flows down the pipe string 192 with the bypass valve 190 in the open position allowing the sensors within MWD collar 188 to determine its orientation within borehole 202. If MWD collar 188 includes an accelerometer, the accelerometer will indicate gravitational direction and thus determine the orientation of reference member 10. The pipe string 192 is rotated to adjust the orientation of reference member 10 and the MWD orientation repeated until reference member 10 achieves its preferred and desired orientation within borehole 202. Once the reference member 10 has achieved its orientation, the bypass valve 190 is closed and the pipe string 192 is pressured up to actuate setting tool 90 to set reference member 10 permanently within the casing 204 of borehole 202. Slips 12, 14 (shown in FIG. 1) on reference member 10 grippingly engage the wall of the casing 204 to permanently set reference member 10 within the borehole 202. In the preferred embodiment, anchor 170 is a packer having packing elements 172 which are compressed to sealingly engage the inner wall of the casing 204. The packing element 172 and the slips 174 or retrievable packer 170 are then set to anchor the whipstock 180 and absorb the compression, tension, and torque applied to the whipstock by the subsequent milling of the window and the drilling of the lateral borehole. An anchor would be used instead of a packer where sealing engagement with the casing is not required.

Figure 12A:
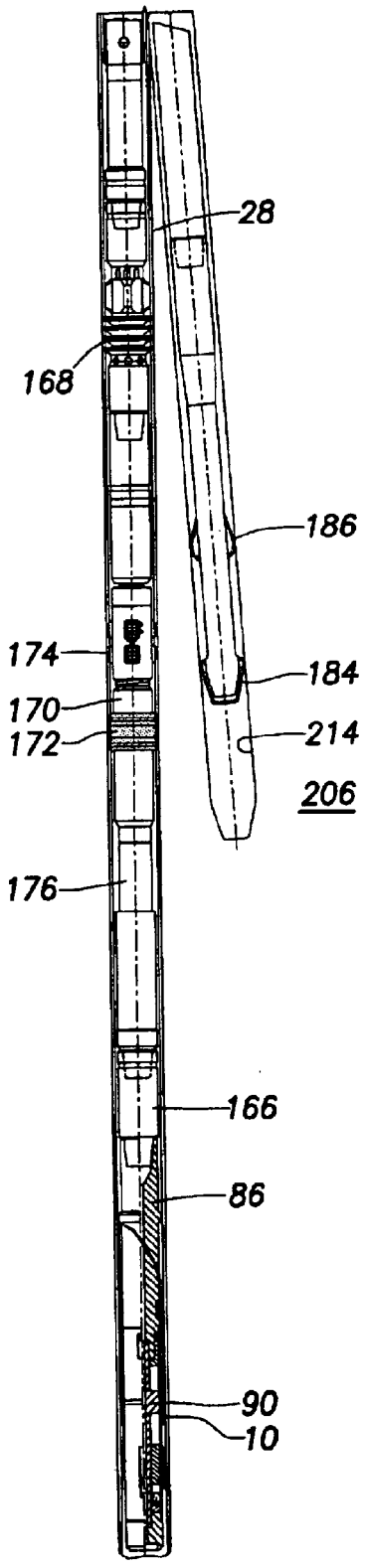
FIGS. 12A–C are a cross-sectional view of the assembly of FIGS. 10A–C while milling a window in the casing string.
Figure 12B:
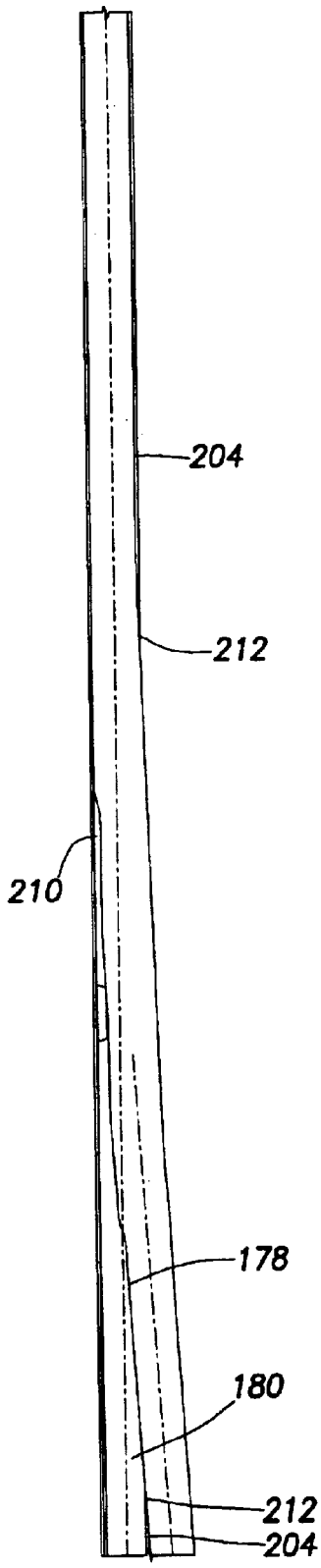
Figure 12C:
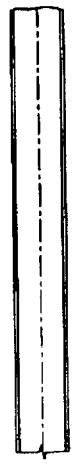

Referring now to FIGS. 12A–C, once packer 170 is set, window mill 184 is released from whipstock 180. Typically, this release is achieved by shearing a shear bolt which connects window mill 184 to the upper end 210 of whipstock 180. It should be appreciated however, that other release means may be provided including a hydraulic release. Upon detachment of mill 184 from whipstock 180, the pipe string (192 of FIGS. 11A–C) rotates the mills 184, 186 which are guided by the face 178 of whipstock 180 to cut a window 212 in casing 204. The mills 184, 186 pass through the window 212 and typically drills a rat hole 214 in the formation 206. Typically the pipe string 192 with mills 184, 186 is then retrieved from the borehole 202.

It should be appreciated that the mill and drill apparatus of U.S. patent application Ser. No. 09/042,175 filed Mar. 13, 1998, entitled "Method for Milling Casing and Drilling Formation", hereby incorporated herein by reference, may be used to continue to drill the first lateral borehole 216, best shown in FIG. 14A–C. The mill and drill apparatus includes a PDC cutter which is used both as the mill to cut window 212 and the bit to cut lateral borehole 216.

Figure 13A:
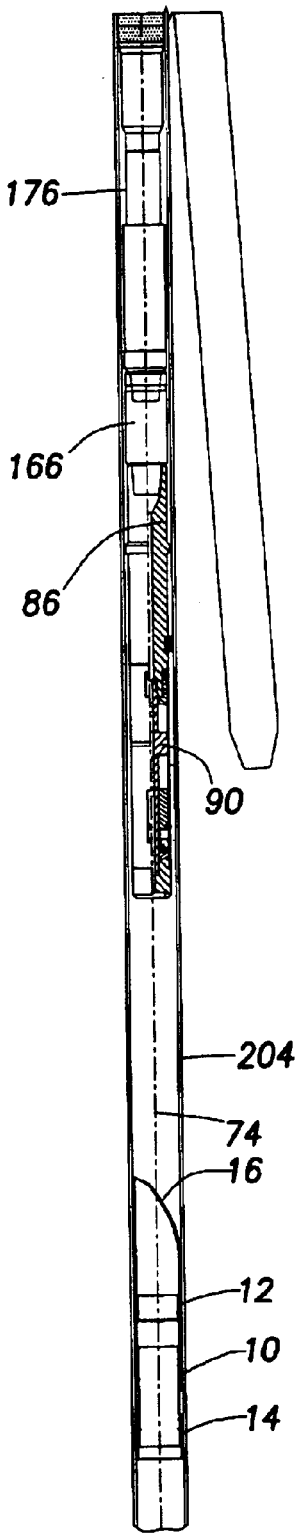
FIGS. 13A–C are elevation views, partly in cross-section, illustrating the setting tool, retrievable packer and whipstock being retrieved from the wellbore, leaving the reference member.
Figure 13B:
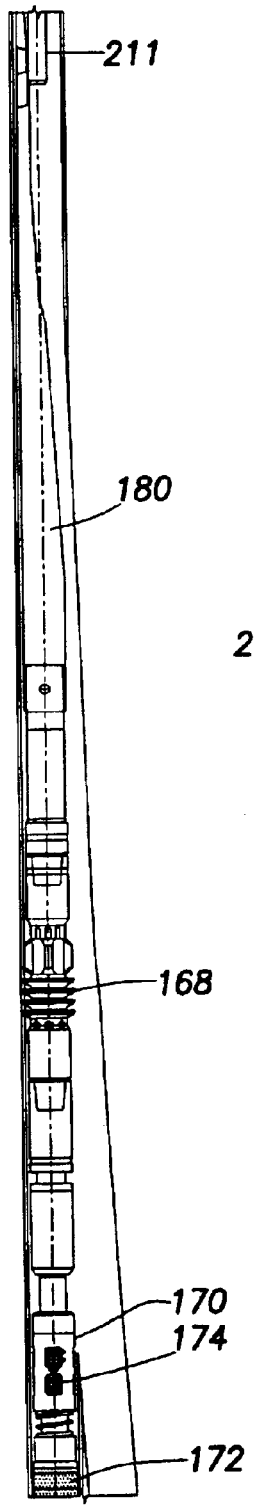
Figure 13C:
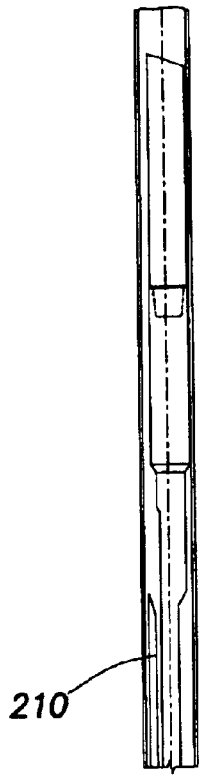

Referring now to FIGS. 13A–C, the setting mechanism 176 of retrievable packer 170 is actuated to unset slips 174 and disengage packing element 172. Since the retrievable packer 170 is not latched to the reference member 10 after the release of setting member 90, the setting member 90, extension member 86, spline sub 166, retrievable packer 170, debris barrier 168, and whipstock 180 may now be retrieved from the well bore leaving reference member 10 permanently installed within casing 204 at a set depth and particular angular orientation about axis 74. A fishing tool (not shown) may then be lowered for attachment to the upper end 210 of whipstock 180 to remove the assembly and leave reference member 10 permanently within borehole 202.

Figure 14A:
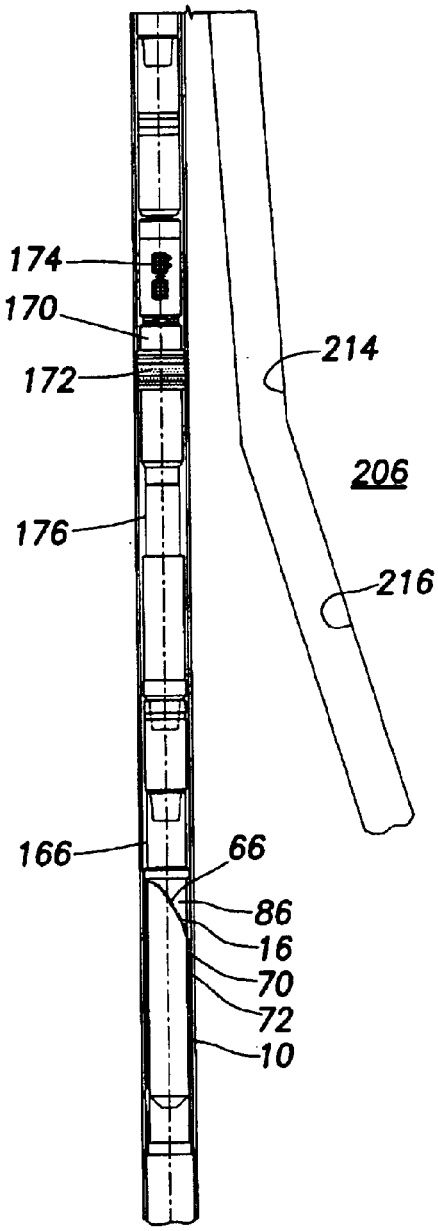
FIGS. 14A–C are an elevation view of a subsequent assembly including a deflector and retrievable packer being landed and oriented on the reference member for re-entering the lateral borehole.
Figure 14B:
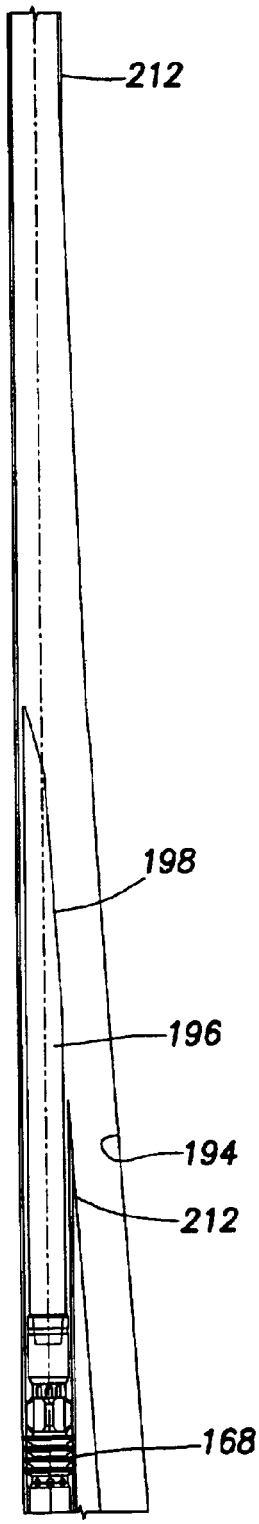
Figure 14C:
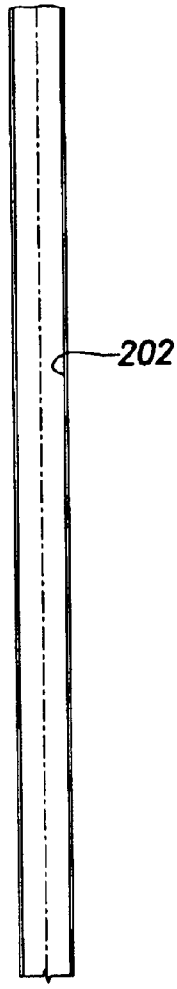

Referring now to FIGS. 14A–C, for re-entering the lateral borehole 194 into formation 192, a bottom hole assembly may be run into the wellbore for working on the lateral borehole 194. In this assembly, the whipstock (180 of FIGS. 13A–C) is replaced with a deflector 196 which is mounted above the debris barrier 168 and retrievable packer 170. The splined sub 166 supports a landing sub or extension member 86 which includes a key 72 which engages orientation surface 66 on orientation member 16. As key 72 engages incline surface 66, key 72 rides downwardly along surface 66 until it is received within slot 70 on orientation member 16. Upon seating orientation key 72 into orientation slot 70, the face 198 of deflector 196 is properly oriented toward lateral 194 so as to guide a work string into lateral 194 to complete operations in the lateral borehole into the formation 192. A work string is deflected through window 212 by deflector 196 for performing operations in the borehole 216. Once work in lateral borehole 216 has been completed, the work string is retrieved and removed from the boreholes 216 and 202. Upon properly orienting the assembly on reference member 10, the packing element 172 and slips 174 of retrievable packer 170 are set to absorb the impact of the, compression, tension, and torsion applied during the operation. The assembly is not latched into reference member 10.

Although the operation describes the reference member 10 being run into the borehole 202 with the assembly of the whipstock 180 and mills 184, 186, it should be appreciated that reference member 10 and releasable setting member 90 may be run into the well independently of the other well tools. The reference member 10 would be set at a predetermined depth and orientation for the subsequent well operation. The assembly for the subsequent well operation would include a locator sub 86 with orientation key 72 to orientingly engage orientation member 16 as previously described to properly orient the well tool for this subsequent operation. If it is desirable to have the well tool oriented in a specific direction, such as on the high side or lower side of the well bore, the well tool may be properly oriented with the landing sub 86 at the surface such that upon the landing sub engaging the orientation member 16 of reference member 10, the well tool will be oriented in the preferred direction.

The orientation of reference member 10 is now known for all subsequent drilling operations. Thus, all subsequent well tools may be oriented by reference member 10 and all subsequent drilling operations conducted and spaced out in relation to reference member 10.

A locator sub 86 may be attached to the lower end of a subsequently lowered well tool for installation on reference member 10. The locator sub 86 causes the orientation of the subsequent well tool in a known orientation within the well bore 202 and spaces out the subsequent well tool a known distance with respect to reference member 10.

Referring now to FIGS. 15A–D, there is shown another assembly 400 of the well reference apparatus and method of the present invention. Assembly 400 includes a locator sub 86, a string of spacer subs 402 extending from locator sub 86 to a retrievable anchor 410 connected to the upper end of spacer subs 402, a debris barrier 432, and a whipstock sub 434 with hinge connector 436 connected to another whipstock 440. Mills 450 are attached to the upper end 456 of whipstock 440 by releasable connection 454. A pipe string 464 extends from the mills 450 to the surface. No orientation member is needed in assembly 400 since assembly 400 is oriented by previously set reference member 10.

The objective of assembly 400 is to drill a second lateral borehole 416 located a specific spaced out distance above first lateral borehole 216 of FIGS. 14A–C). This spaced out distance is determined by knowing the length of each of the members in assembly 400 in relation to reference member 10.

Where the spaced out distance above reference member 10 is a length which allows the assembly of assembly 400 to be made at the surface, the assembly 400 is assembled and the orientation of the face 442 of whipstock 440 is scribed along the face of the members making up assembly 400 down to locator sub 86. Locator sub 86 is then oriented to properly align with face 442 of whipstock 440 upon installation. Although FIG. 15A appears to illustrate second lateral borehole 416 as being on the opposite side of the cased borehole from first lateral borehole 216, it should be appreciated that the face 442 may be directed in any orientation in borehole 202.

It should also be appreciated that should the spaced out distance of assembly 400 be of a length such that it is not practical to make up the assembly 400 at the surface so as to easily align locator sub 86, the locator sub 86 may be separated into an adjustable connector sub and an orientating latch sub. The orienting latch sub is mounted on the lower end of the spacer subs 402 and the adjustable connector sub is disposed adjacent the whipstock 440, such as between the upper end of the string of spacers 402 and retrievable anchor 410. In this embodiment, the orientation of the lower orientating latch sub would be scribed along the string of spacer subs and then the assembly of the retrievable anchor 410, whipstock 440, and mills 450 are assembled as a unit for connection to the adjustable connector sub at the upper end of spacer sub 402. The adjustable connector sub allows the whip face 442 to then be properly aligned using the scribing on the spacer subs, so as to be aligned with the lower orienting latch sub which will have a known orientation with reference member 10 upon installation.

In operation, assembly 400 is lowered into borehole 202 with locator sub 86 stabbing into reference member 10 to orient assembly 400 in the preferred orientation for the drilling of second lateral borehole 416. Retrievable anchor 410 is then actuated to grippingly engage the casing 204. Retrievable anchor 410 provides support for whipstock 440. Without retrievable anchor 410, the milling and drilling operations on whipstock 440, suspended many feet above reference member 10, causes instability in the milling and drilling operations. The mills 450 are then detached from whipstock 440 and the whipstock face 442 guides and deflects the mills 450 into the casing 204 to mill a second window 412 and drill rat hole 414.

As shown in FIG. 15B, the mills 450 are retrieved and a drilling string with a standard bit is lowered into the well to begin the drilling of second lateral borehole 416.

As shown in FIG. 15C, a fishing tool 418 may be used to retrieve whipstock 440 and, as shown in FIG. 15D, a deflector 380 is attached to a locator sub 86 and spaced out in relation to reference member 10. This assembly is then be lowered into the borehole for orientation on reference member 10.

A work string with standard drill bit may then again be lowered into the well and guided through the window 412 by deflector 380 and into the second lateral borehole 416.

Referring now to FIGS. 16A–C, there is still another preferred embodiment of the reference well apparatus and method. An assembly 500 includes a locator sub 86, debris barrier 532, and a connector sub 534 for connecting to the lower end of a tieback insert 510. A running tool 512 on the lower end of a drill string 564 is connected to the upper end of tieback insert 510. One embodiment of tieback insert 510 is shown and described in U.S. Provisional Patent Application Serial No. 60/116,160, filed Jan. 15, 1999, and in U.S. patent application Ser. No. 09/480,073, filed Jan. 10, 2000 entitled Lateral Well Tie-Back Method and Apparatus, both hereby incorporated herein by reference. Tieback insert 510 includes a main bore 512 and a branch bore 514. Main bore 512 is to be aligned with the existing borehole 202 while the branch bore 514 is to be aligned with one of the lateral boreholes such as for example lateral borehole 216. For branch bore 514 to be properly aligned with lateral borehole 216, it is necessary that the tieback insert 510 be properly oriented within existing borehole 202.

In operation, the assembly 500 is assembled at the surface with branch bore 514 properly aligned on locator sub 86 so as to be in proper alignment with lateral borehole 216 upon orientation with reference member 10.

In yet another embodiment of the well reference apparatus and method, the reference member 10 may be used in performing operations below reference member 10. Since reference member 10 has through bore 80, access is provided below reference member 10. For example, a liner may be supported from the reference member 10 and include an orientation slot for engagement with reference member 10 to align the liner. To provide the necessary sealing, a packer would be set above the reference member 10 for packing off the liner hanger with the casing 204. By avoiding the reference member having a mandrel, the bore of the reference member 10 will allow the passage of a ideally sized liner and couplings since the reference member 10 will have a wall thickness equal to or less than that of the wall thickness of the liner hanger. Thus no bore diameter is lost. The liner hanger is anchored above the reference member. The liner may include a precut window to allow the drilling of another lateral borehole extending through the liner window below reference member 10. Another example includes the support of a tubing string below reference member 10 for the production of a lower producing formation located below reference member 10.

The reference member 10 is relatively thin and may be easily removed from the well if necessary. One method of removing reference member 10 from casing 204 would be through the use of a mill.

The well apparatus and method provides many advantages over the prior art.

The reference member 10 allows the use of a retrievable packer 170 rather than a permanent big bore packer. A retrievable packer has the advantage in that it may be used again thus saving additional expense.

The reference member 10 only need engage the casing a sufficient amount so as to allow the orienting stinger 85 from the landing sub 86 to ride down the inclined surface 66 of orientation member 16 so as to be properly located in depth and properly angularly oriented about the axis.

Another advantage of the reference member is that the bore therethrough approximates the drift diameter and thus is greater than the diameter of the bore of a big bore packer. The larger bore through the reference member permits flowbore operations below the reference member which is a further advantage.

The reference member 10 has a larger bore to allow the passage of larger perforation guns to perforate a formation located below the reference member in the existing borehole. This is also an advantage in new wells where larger perforation guns are used to complete the primary well bore and then used to complete the lateral borehole. Large perforating guns will not pass through a big bore packer.

The reference member provides a substantial economic advantage over the use of a packer or anchor as a reference and orientation device. Since the reference member is not required to withstand the compression, tension, and torque of the well operation, the construction of the reference member may be of a simple construction, particularly as compared to a packer, and thus be a relatively inexpensive tool. Since the reference member only requires a minimum number of parts, i.e. upper and lower slips, upper and lower cones, and an orientation member, a minimum number of parts must remain down hole and also allow the bore through the reference member to be maximized.

The reference member has the further advantage of not requiring a latch. A packer and anchor require that the whipstock be latched to the packer and anchor so as to withstand the compression, tension, and torque of the well operation. Since the packer and anchor are independent of the reference member, the packer and anchor need not be latched to the reference member since the packer and anchor themselves have cones and slips for biting engagement into the casing.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An assembly to locate a well tool in a cased borehole, comprising:

a reference member having first and second slips and first and second cones engaging said first and second slips respectively;

said first and second cones having overlapping portions;

a ratchet member disposed between said overlapping portions allowing the separation of said cones but preventing their contraction; and an orientation surface mounted on said first or said second slip.

2. The assembly of claim 1 wherein said ratchet member is disposed on one of said first and second cones and the other of said first and second cones having wickers, said ratchet member having ratchet teeth engaging said wickers.

3. The assembly of claim 1 wherein said orientation surface includes an inclined surface with an apex and a slot adapted to receive an orientation key.

4. The assembly of claim 1 wherein said orientation surface is an orientation key.

5. The assembly of claim 1 further including an expansion joint on one of said first and second cones.

6. The assembly of claim 1 further including a setting member to separate said first and second cones.

7. The assembly of claim 6 wherein said setting member includes piston members releasably attached to said cones, said pistons being hydraulically actuated to move said cones into engagement with said slips.

8. The assembly of claim 6 wherein said setting member removably supports one of said cones.

9. A method of installing a well tool in a cased borehole for performing a well operation, comprising:

lowering a reference member and an anchor member with the well tool into the cased borehole;

lowering a whipstock and a mill with the reference member and anchor member;

setting the reference member within the cased borehole;

then setting the anchor member in the cased borehole;

detaching the mill from the whipstock and milling a window into the cased borehole; and performing the well operation with the well tool.

10. A method for setting a marker in the borehole of a well, comprising:

running a reference member and orientation tool into the borehole;

determining the orientation of the reference member;

rotating the reference member;

repeating the determining and rotating steps until the reference member is properly oriented in the borehole;

permanently setting the reference member within the borehole;

lowering a locator member with anchor and well tool into the borehole;

orienting the locator member on an orientation member on the reference member;

setting the anchor member; and performing a well operation with the well tool.

11. A method for milling a window in a cased wellbore, comprising:

disposing into the wellbore a reference member, a reference member setting tool and a sidetracking assembly including an anchor, whipstock and a mill adapted to mill the window in the cased wellbore;

determining the orientation of the reference member within the cased wellbore;

operating the setting tool, either before or after determining the orientation of the reference member, to set the reference member within the cased wellbore;

setting the anchor; and milling the window in the cased wellbore.

12. The method of claim 11 wherein the setting tool is released from the reference member after the reference member is set.

13. The method of claim 11 wherein the setting tool comprises actuating a piston assembly within the setting tool causing a camming member in the reference member to expand slips into engagement with the cased borehole.

14. The method of claim 13 wherein the anchor includes a setting tool and the anchor setting tool sets the anchor in the cased borehole.

15. The method of claim 13 wherein the setting tool sets the anchor.

16. The method of claim 11 further comprising releasing the setting tool from the reference member; and removing the setting tool from the wellbore.

17. A method of conducting sidetracking operations, comprising:

conducting a first run into a borehole to:

set a reference member, orient a whipstock, set an anchor within the borehole, and mill a window in the borehole, conducting a second run into the borehole to:

land and orient a deflector within the borehole, and conduct lateral operations within the borehole.

18. The method of claim 17 wherein a locator member is mounted on the deflector and engages the reference member to orient the deflector within the borehole using an orienting profile.

19. An apparatus for conducting sidetracking operations within a borehole comprising:

a reference member;

a setting tool affixed to an anchor assembly for setting the reference member within the borehole, the anchor assembly including an anchor and a setting tool for setting the anchor; and a whipstock affixed to the anchor assembly for use in milling a window in a portion of the borehole.

20. The apparatus of claim 19 wherein the reference member setting tool, whipstock and anchor assembly are selectively removable from the borehole.

21. The apparatus of claim 19 wherein the reference member setting tool comprises a reciprocable piston member that is actuated to set a cam slips into engagement with a portion of the borehole that was cased to secure the reference member within the borehole.

* * * * *